US006286730B1

(12) United States Patent
Amidzich

(10) Patent No.: US 6,286,730 B1
(45) Date of Patent: Sep. 11, 2001

(54) VALVE ASSEMBLY FOR CONTROLLING FLUID INGRESS AND EGRESS FROM A TRANSPORTABLE CONTAINER WHICH STORES AND DISTRIBUTES LIQUID UNDER PRESSURE

(75) Inventor: Bradford G. Amidzich, Oconomowoc, WI (US)

(73) Assignee: Vent-Matic Co., Inc., Milwaukee, WI (US)

( * ) Notice: Subject to any disclaimer, the term of this patent is extended or adjusted under 35 U.S.C. 154(b) by 0 days.

(21) Appl. No.: 09/649,421

(22) Filed: Aug. 28, 2000

Related U.S. Application Data

(63) Continuation-in-part of application No. 09/098,268, filed on Jun. 16, 1998, now Pat. No. 6,109,485.

(51) Int. Cl.[7] ..... B65D 83/00
(52) U.S. Cl. ..... 222/400.7; 222/396; 137/212
(58) Field of Search ..... 222/400.7, 400.8, 222/396, 397; 137/212, 322

(56) References Cited

U.S. PATENT DOCUMENTS 3,672,390 * 6/1972 Gravesteijn ..... 137/212
4,529,105 * 7/1985 Lewins ..... 222/400.7
4,548,343 * 10/1985 Gotch ..... 222/400.7
5,645,192 * 7/1997 Amidzich ..... 222/397
6,109,485 * 8/2000 Amidzich ..... 222/396

* cited by examiner

*Primary Examiner*—Philippe Derakshani
(74) *Attorney, Agent, or Firm*—Boyle Fredrickson Newholm Stein & Grat S.C.

(57) ABSTRACT

A valve assembly has (1) a riser pipe including a valve cup housing and portals blockable, and (2) a central tower which communicates with blockable pathways that pass both liquid and gas, and (3) a bi-directional valve member which controls separation of gas and liquid and directional flow in the chamber. A retainer assembly is provided on the outer peripheral surface of the valve cup so as to facilitate insertion of the valve cup into the container but so as to prevent the unintended removal of the valve cup from the container while still permitting selective valve cup removal when it is desired to do so. The retainer assembly preferably includes a protrusion and a pair of centering skids spaced about the outer periphery of the valve cup. The protrusion includes a radially tapered, vertical extending detent portion and a radially tapered, circumferentially extending ramp portion. The centering skids taper radially inwardly from vertically central portions thereof to the vertical end portions thereof. Upon simultaneous twisting and tilting of the valve cup relative to an annular member on the container such as the shoulder of a stub, the centering skids engage the annular member so as to take up the clearance between the valve cup and the annular member, and the protrusion ramps onto the annular member in a self-threading manner so as to circumferentially distort the valve cup and to permit the valve cup to be turned out of the container.

22 Claims, 29 Drawing Sheets

VALVE ASSEMBLY FOR CONTROLLING FLUID INGRESS AND EGRESS FROM A TRANSPORTABLE CONTAINER WHICH STORES AND DISTRIBUTES LIQUID UNDER PRESSURE

CROSS REFERENCE TO A RELATED APPLICATION

This application a continuation-in-part of U.S. patent application Ser. No. 09/098,268, filed Jun. 16, 1998 now U.S. Pat. No. 6,109,485 and entitled "Self Regulating Valve Assembly for Controlling Fluid Ingress and Egress From a Transportable Container Which Stores and Distributes Liquid Under Pressure."

BACKGROUND OF THE INVENTION

The invention relates to valve arrangements or valve assemblies and, in particular, relates to valve assemblies for transportable containers of the type serving to store and distribute a liquid under pressure from a propellant gas. The liquid to be stored and dispensed could comprise a beverage, a concentrate, a plant protection agent, or virtually any other transportable liquid.

The typical valve assembly of the above-mentioned type comprises (1) a ring-shaped stub secured in an upper opening of a container such as a barrel; (2) a valve housing; (3) a riser pipe arranged co-axially with an upper reception area in the valve housing such that the riser pipe and outlet valve can be displaced axially, against the biasing force of springs mounted within and about the valve housing, from an upper closed valve position to a lower open valve position; and (4) retaining parts which hold all parts in position within the stub. In previously-known valve assemblies of this type, the valve assembly can be readily disassembled before the gas pressure in the container has been fully relieved. Residual gas pressure in the container can force the valve components out of the container opening at high velocities with substantial risk to personnel and/or surroundings.

The problem of unauthorized disconnection of a pressurized container is addressed and at least partially solved in U.S. Pat. No. 5,242,092 to Riis et al. (the Riis patent). The valve assembly disclosed in the Riis patent includes, in addition to the stub, the riser pipe, valves, and springs, an obliquely and downwardly protruding finger provided on the lower free end of the riser pipe. The finger is spaced from the top of the riser pipe and cooperates with the remainder of the riser pipe such that the valve can only be dismounted completely when the riser pipe is in or in the vicinity of its bottommost position. Since pressure within the container forces the riser pipe upwardly and the finger therefore can be pushed into its lower position only in the absence of significant pressure, within the container, the finger functions to prevent damage which might occur if unauthorized persons were to attempt to disconnect the valve before the gas pressure in the container has been completely relieved.

The valve assembly disclosed in the Riis patent, though solving at least one of the problems exhibited by most valve assemblies, does not solve other problems associated with conventional valve assemblies. For instance, it cannot relieve excessive gas pressures within the container which may be generated when the container is subjected to external forces such as excessive shaking or other mechanical agitation or fire or other thermal agitation. The valve assembly disclosed in the Riis patent and other, traditional valve assemblies are designed only to keep the contents within the container, not to regulate the pressure within the container.

Hence, traditional valve assemblies cannot prevent gas pressures within the container from reaching or even exceeding explosive levels in the presence of external agitation forces. Even if these external forces are less severe such that gas pressures within the container do not reach explosive levels, the higher-than desired pressure within the container still may render the contents dangerous to handle when making connection to dispensing equipment.

Another problem associated with previously-known valve assemblies is the problem of unintended and premature liquid escape during valve coupling. Presently-available valve assemblies are designed to cooperate with a coupling head which can be fixed in the valve or on the stub to form a sealed coupling. The coupling head, such as that manufactured by Perlick under the model number MK-1, connects the valve with a source of pressurized gas and with a liquid dispenser such as tapper. When the coupling head is seated and activated, an axially displaceable spindle is forced downwardly, setting-in-motion a two stage valve opening sequence. First the spindle comes in contact with the liquid valve plug, forcing it downwardly against a spring within the riser pipe, thereby opening the liquid passage. The spindle continues downwardly while making contact with the riser pipe itself, forcing the riser pipe downwardly against a second spring so that the riser pipe moves downwardly opening the gas passage, thereby completing the sequence and theoretically dispensing liquid only after the coupling head has been sealed and gas pressure has been applied. However, due at least in part to the fact that there are two separate pathways in the present assemblies, one being for gas and one for liquid, the liquid contents of the container is pushed to the very exit point of the liquid pathway by pre-existing gas pressure within the container. Now, when a per-activated coupling head is pressed into the I.D. of the housing, it will enter the liquid pathway before the coupling head seals against the container, thereby allowing the liquid contents to escape from the valve assembly and into the ambient atmosphere during the interval of time between initial liquid pathway opening and the time that the coupling head seals against the container.

Another disadvantage of the valve arrangement disclosed in the Riis patent lies in the configuration of its safety mechanism for preventing the valve from being removed completely from the container before the gas pressure in the container has been fully vented. That safety mechanism includes a relatively complex structure including an outwardly projecting finger on the valve cup or housing and a catch on a downwardly extending protrusion on the stub. An upper edge of the catch protrudes far enough from the wall of the housing to abut the inner side of the stub in all positions of the riser pipe when the catch is in a first position thereof, thereby preventing valve removal. When the catch is deflected to a release position, the outer end of the catch is substantially flush with the inner surface of the stub permit valve removal. This configuration is expensive to manufacture because it requires the provision of a special stub that extends below the surface of the container. Its catch is also difficult to fabricate and difficult to operate.

SUMMARY OF THE INVENTION

In accordance with a first aspect of the invention, a valve assembly is provided for selectively permitting a liquid to be dispensed from a container under gas pressure within the container. The valve assembly is mountable on a stationary stub surrounding an aperture in the container and includes a valve seat, a valve element, and a valve cup. At least a portion of the valve element is movable between a first position in which the valve element seals against the valve seat to block pressurized gas flow into the container and a second position in which the valve element unseats from the valve seat to permit pressurized gas flow into the container and liquid flow out of the container. The valve cup is mounted in an opening of the container and cooperates with the valve element. A releasable retainer assembly is provided on an a radially and circumferentially distortable outer wall of the valve cup. The retainer assembly includes a protrusion that 1) tapers radially inwardly from an upper portion thereof to a lower portion thereof so as to act as a detent that is configured to engage the stub to distort the outer wall of the valve cup radially when the valve cup is inserted into the opening from above and which thereafter prevents vertical removal of the valve cup from the opening, and 2) tapers radially outwardly from a circumferential leading portion thereof to a trailing portion thereof to act as a ramp that is configured to engage the stub and to distort the outer wall of the valve cup when the valve cup is rotated with the retainer assembly in contact with the stub, thereby permitting the valve cup to be rotated out of the stub.

The retainer assembly preferably further comprises first and second radially tapered, vertically extending centering skids that are spaced circumferentially from one another and from the protrusion. In order to permit the valve cup to rock about the centering skids to wedge the protrusion against the stub, both of the centering skids taper radially inwardly from a vertically central portion thereof towards opposed vertical ends thereof. In order to enhance the self-threading nature of the retainer assembly, an upper end of the protrusion preferably is positioned above an upper end of one of the first and second centering skids and beneath an upper end of the other of the first and second centering skids.

Preferably, the protrusion includes 1) a detent portion which tapers radially inwardly from an upper portion thereof and 2) a self-threading ramp portion which is located circumferentially adjacent the detent portion and which tapers radially outwardly from a circumferential leading edge thereof to a circumferential trailing edge thereof.

In accordance with another aspect of the invention, a method is provided for inserting a valve cup into an opening in a container and removing it from the opening. During the insertion step, a detent of a retainer assembly on the valve cup engages an annular member that surrounds the opening and forces an outer wall of the valve cup to elastically distort radially, thereby permitting the valve cup to be forced past the annular member and into the container. The removing step includes lifting the valve cup to an intermediate position in which additional vertical movement of the valve cup is blocked by engagement between an upper surface of the detent and a lower surface of the annular member, and then turning the valve cup relative to the annular member so as to cause a circumferentially tapered surface on the retainer assembly to engage the annular member and distort the outer wall of the valve cup, thereby permitting the valve cup to be rotated out of the stub.

The removing step preferably comprises, after the step of lifting the valve cup to the intermediate position, tilting the valve cup to force the tapered surface against the annular member. During this tilting step, an upper portion of a first centering skid engages a vertical face of the annular member, and a lower portion of a second centering skid engages the vertical face of the annular member. Both of the centering skids taper radially inwardly from a vertically central portion thereof towards opposed vertical ends thereof.

Preferably, during the turning step, the tapered surface self-threads against an essentially planar surface on the annular member.

The foregoing and other features and advantages of the invention will become apparent from the following detailed description of the preferred embodiments, read in conjunction with the accompanying drawings. The detailed description and drawings are merely illustrative rather than limiting, the scope of the invention being defined by the appended claims and equivalents thereof.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Figure 1:
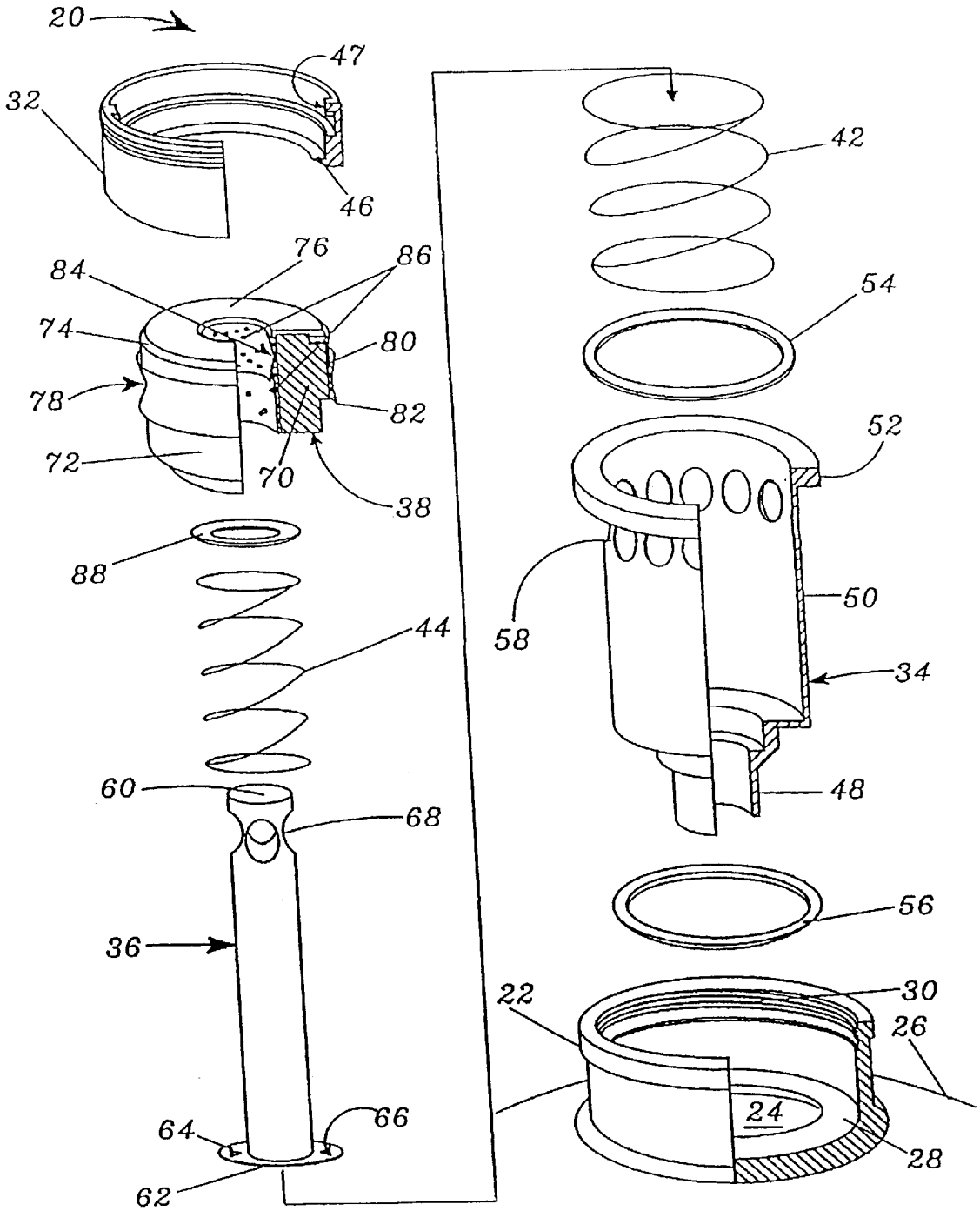
FIG. 1 is an exploded perspective view of the individual parts as they would be assembled together so as to make up a valve assembly according to a first embodiment of the invention.

Pursuant to the invention, a valve assembly has (1) a single valve cup which acts as the riser pipe and the valve housing and which has interior portals that are blockable, and (2) a central tower which communicates with blockable pathways that pass both liquid and gas, and (3) a bi-directional valve member which controls separation of gas and liquid and directional flow in the chamber, which allows only gas to be present at the point of coupling transition until the valve assembly is fully coupled, and that regulates the internal gas pressure of the container when no coupling is engaged. A retainer assembly is provided on the outer peripheral surface of the valve cup so as to (1) facilitate insertion of the valve cup into the container but (2) so as to prevent the unintended removal of the valve cup from the container while still permitting selective removal when it is desired to do so. The retainer assembly preferably includes a protrusion and a pair of centering skids spaced about the outer periphery of the valve cup. The protrusion includes a radially tapered, vertically extending detent portion and a radially tapered, circumferentially extending self-threading ramp portion. The centering skids taper radially inwardly from vertically central portions thereof to the vertical end portions thereof Upon simultaneous twisting and tilting of the valve cup relative to an annular member on the container, the centering skids engage the annular member so as to take up the clearance between the valve cup and the annular member, and the protrusion ramps onto the annular member in a self-threading manner so as to circumferentially distort the valve cup and to permit the valve cup to be turned out of the container. Due to this configuration, fewer parts are used in the same space, allowing for greater cross-sectional ingress and egress areas, thereby improving fill and discharge rates and reducing costs to the end user while providing improved safety. The parts can be made to retrofit existing equipment.

2. Description of First Embodiment

Turning now to the drawings and initially to FIGS. 1–4 in particular, the inventive valve assembly 20 is designed for connection to a standard stub 22 surrounding an aperture 24 in a container 26. Container 26 may comprise a barrel or any other transportable or stationary structure for storing beverages or other liquids and for dispensing the stored liquids under gas pressure. The stub 22 coaxially surrounds the aperture 24 in the container 26 and is fixed to the container 26, e.g., by welding. Stub 22 presents an internal radial shoulder 28 supporting the riser pipe or valve cup 34 as detailed below and also presents upper radial threads 30 for connection to a housing 32 of the valve assembly 20 also as detailed below.

Valve assembly 20 includes as its major components a housing 32 which also functions as a retainer for the remaining components of the valve assembly 20, a stationary riser pipe 34, a dispensing tower 36, and a sealing ring 38. An annular chamber 40 is formed between the dispensing tower 36 and the riser pipe 34. This single chamber 40 contains liquid and/or gas depending upon the vertical position of sealing ring 38 within the chamber 40. Dispensing tower 36 of the illustrated embodiment is movable vertically with respect to the riser pipe 34. The sealing ring 38 and dispensing tower 36 are biased towards the positions illustrated in FIG. 2 by first and second springs 42 and 44 detailed below.

The housing 32, which is threaded into the threads 30 of the stub 22, serves to enclose the remaining components of the valve assembly 20 and to retain them in place during operation of the assembly. The housing 32 presents an internal ring 46 which defines an upper limit of travel of the sealing ring 38 as detailed below. Housing 32 also presents inwardly-extending radially lugs 47 for cooperation with a conventional coupling head in a manner which is, per se, well known.

The riser pipe 34 functions both to serve as a valve cup, i.e., a housing and outer seat for the sealing ring 38, and as a more traditional pipe for directing liquid in the container 26 into the upper portions of the valve assembly 20 from the lower portions of the container. The riser pipe 34 is stepped so as to present a lower portion 48 of relatively narrow diameter separated from an upper portion 50 of relatively large diameter by a shoulder. Upper portion 50 surrounds the chamber 40 and slidably receives and guides the sealing ring 38. An outwardly radially extending flange 52 is formed on the upper end of the riser pipe 34 and is clamped between the shoulder 28 of the stub 22 and the bottom end of the housing 32 with the aid of upper and lower sealing rings or gaskets 54 and 56. A plurality of circumferentially-spaced ingress/egress portals or openings 58 are formed in the upper portion 50 of the riser pipe 34 at a location beneath the flange 52.

The purpose of the dispensing tower 36 is to provide a pathway for flow of liquid or gas (depending upon the operational state of the valve assembly) out of the container 26, to guide the inner periphery of the sealing ring 38 during axial movement thereof, and to cooperate with the sealing ring 38 to selectively prevent and permit fluid flow from the container 26. The dispensing tower 36 is sealed at its upper end by a cap 60 preferably formed integrally with the tubular tower. The lower end of the dispensing tower 36 is open and presents an outwardly extending radial flange 62 which normally rests on the shoulder of the riser pipe 34. Triangular projections 64 are punched upwardly from the flange 62. Projections 64 radially center the spring 44 and prevent excessive radial movement of the bottom end of the spring 44. A plurality of openings 66 are formed in the flange 62 when the projections 64 are punched. The openings 66 assure free flow of fluid between the annular chamber 40 and the interior of the riser pipe 34. In addition, a plurality of circumferentially spaced discharge openings or portals 68 are formed through the wall of the dispensing tower 36 near its upper end.

The sealing ring 38 performs two functions. First, it serves as a valve element, selectively opening and closing the portals 58 and 68 and exposing them to various fluids, i.e., either a gas or a liquid. Secondly, it guides the dispensing tower 36 and maintains the perpendicularity and eccentricity between the sealing ring 38, the dispensing tower 36, and the riser pipe 34, thereby enhancing sealing. The sealing ring 38 could conceivably be formed entirely out of rubber or another polymeric material but, in the illustrated embodiment (FIG. 2), is formed from an inner, rigid, thermally degradable, insert 70 surrounded by a layer 72 of a molded polymeric material such as synthetic or natural rubber.

Figure 2:
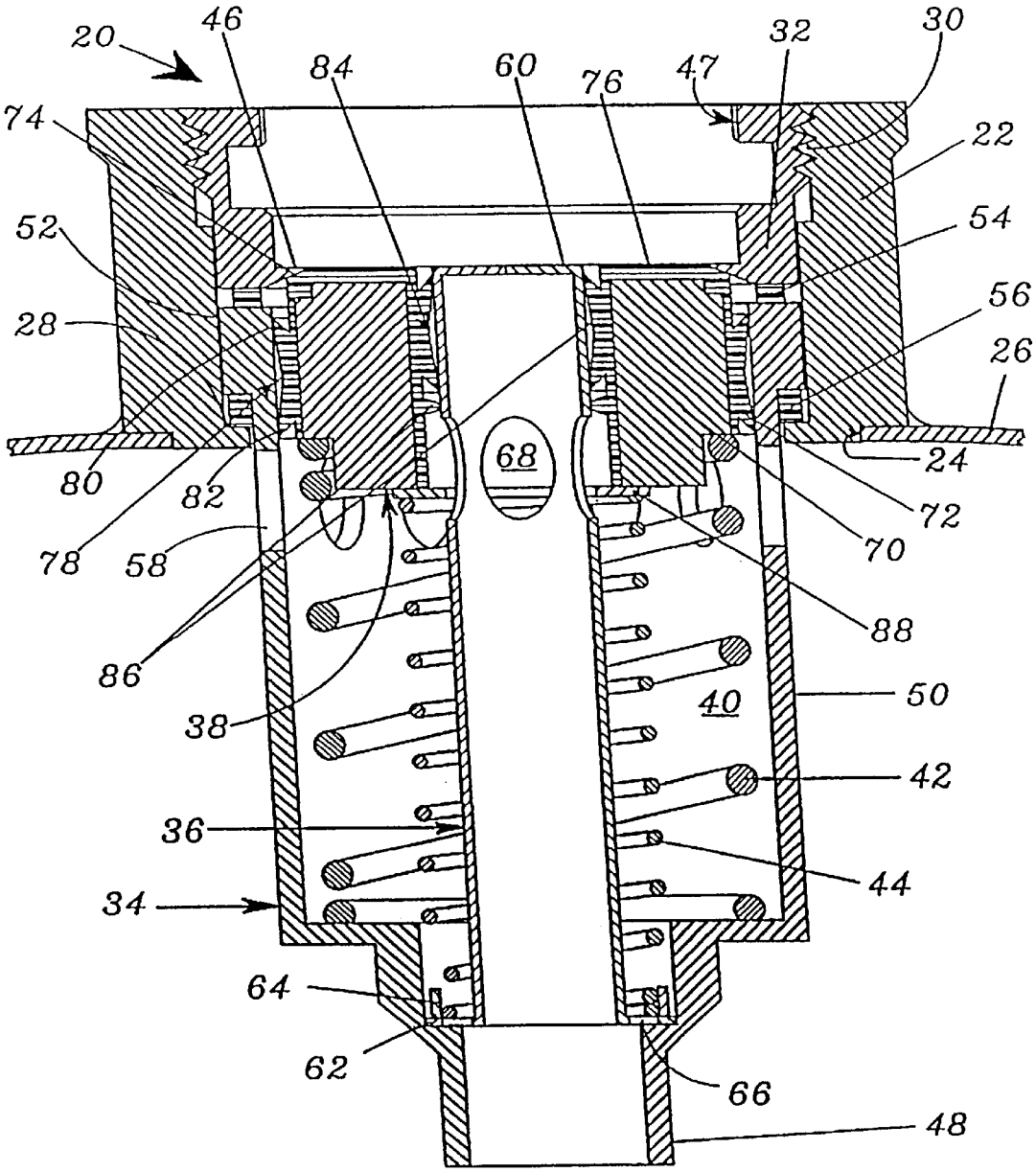
FIG. 2 is a sectional elevation view of the valve assembly of FIG. 1 and illustrating the valve assembly in its neutral or closed mode.

The outer portion of the upper end of the sealing ring 38 presents a chamfer 74 which complements the shape of the retaining ring 46 of housing 32, 74 seals against 46 when the sealing ring 38 is in its uppermost position illustrated in FIG. 2. The inner radial portion of the upper end surface of the sealing ring 38 presents a flat sealing face 76 for contact with a spindle as detailed below. A first circular sealing lip 78 extends radially outwardly from the outer periphery of the sealing ring 38 and engages and seals against the internal surface of the riser pipe 34. The first sealing lip 78 is generally V-shaped and includes an upper sealing surface 80 and a lower sealing surface 82 both of which engage the internal surface of the riser pipe 34 and between which is formed an annular space that reduces contact friction and make the sealing lip very pliant. This can be enhanced with very slender annular face rib(s) on sealing surface 80 and 82 (not present in this embodiment). This generally V-shaped configuration of the lip 78 (1) provides bi-directional sealing at very low pressure, preventing fluid from flowing past the lip 78 either from above or below and (2) facilitates initial movement of the sealing ring 38 within the riser pipe 34 and prevents damage or abrasion of the sealing ring 38. A second circular V-shaped lip 84 extends radially inwardly from the inner peripheral surface of the sealing ring 38 and is positioned above the discharge portals or openings 68 when the valve assembly 20 is in its neutral or closed position illustrated in FIG. 2. Finally, a plurality of frusto-conical centering projections 86 extend radially from the sealing ring 38. These projections 86 could extend from the inner peripheral surface of the sealing ring 38 as illustrated, from the outer peripheral surface, or from both. They also could be supplemented or replaced by diagonal, and/or spiral, or vertical ribs (not present in this embodiment). These projections 86 guide and stabilize the sealing ring 38 with respect to the member they contact (the dispensing tower 36 in the illustrated embodiment) while maintaining the eccentricity of these elements and permitting the free-flow of fluid past the projections 86. The illustrated projections 86 are formed integrally with the polymeric layer 72, but it is conceivable that they could be formed from a separate structure or even from projections of the insert 70 extending through the polymeric layer 72. Sealing ring 38 is biased into its uppermost position illustrated in FIG. 2 both by the first or sealing spring 42 and the second or vent spring 44. The sealing spring 42 is seated against the bottom surface of the insert 70 at its upper end and against a step in the riser pipe 34 at its upper end. The second or vent spring 44 is seated at its lower end against the flange 62 of the dispensing tower 36 and at its upper end against a spacer 88 positioned between the spring 44 and the bottom surface of the polymeric layer 72.

Figure 3:
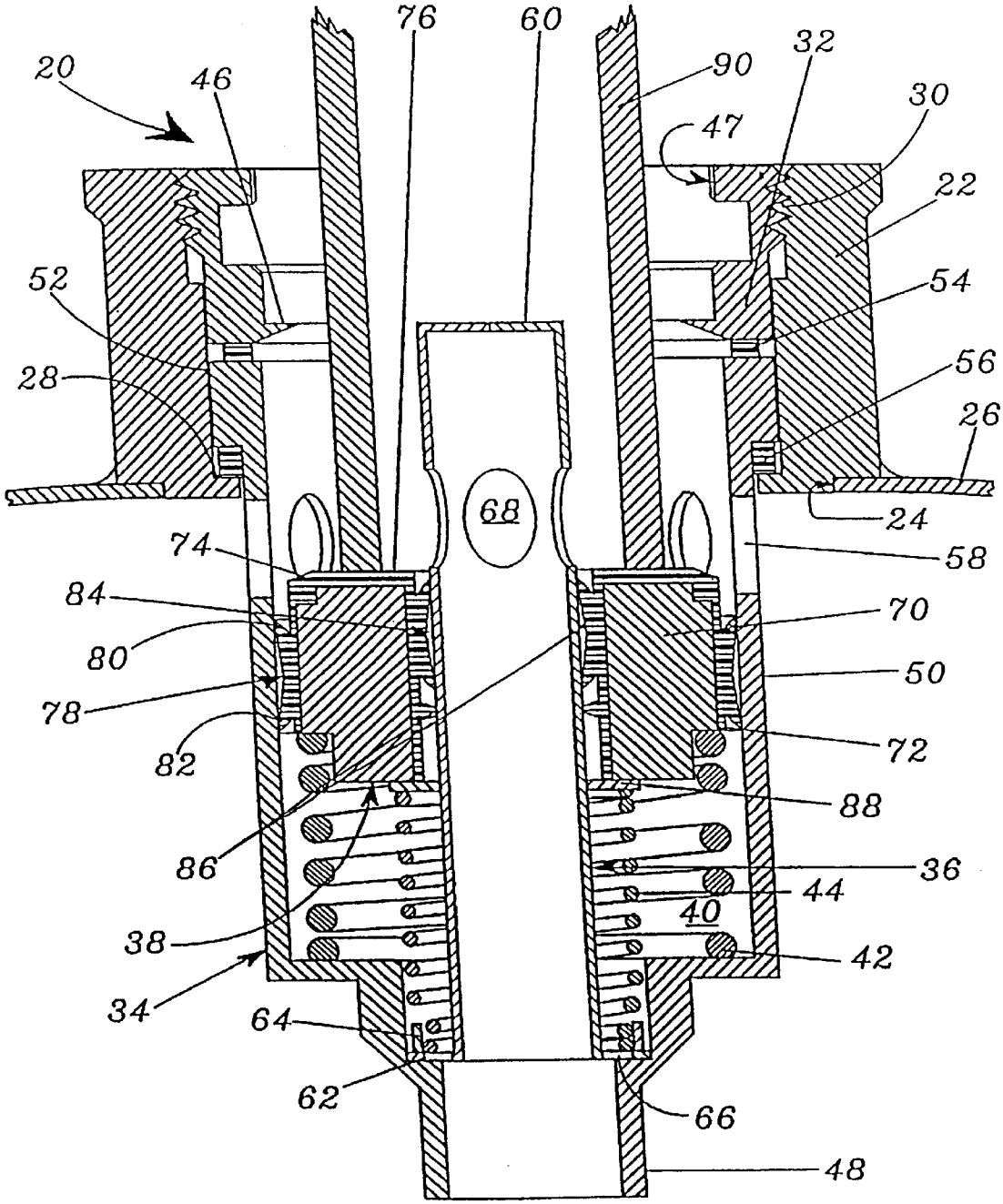
FIG. 3 is a sectional elevation view of the valve assembly of FIGS. 1 and 2 and illustrating the valve assembly in its normal or working mode.
Figure 4:
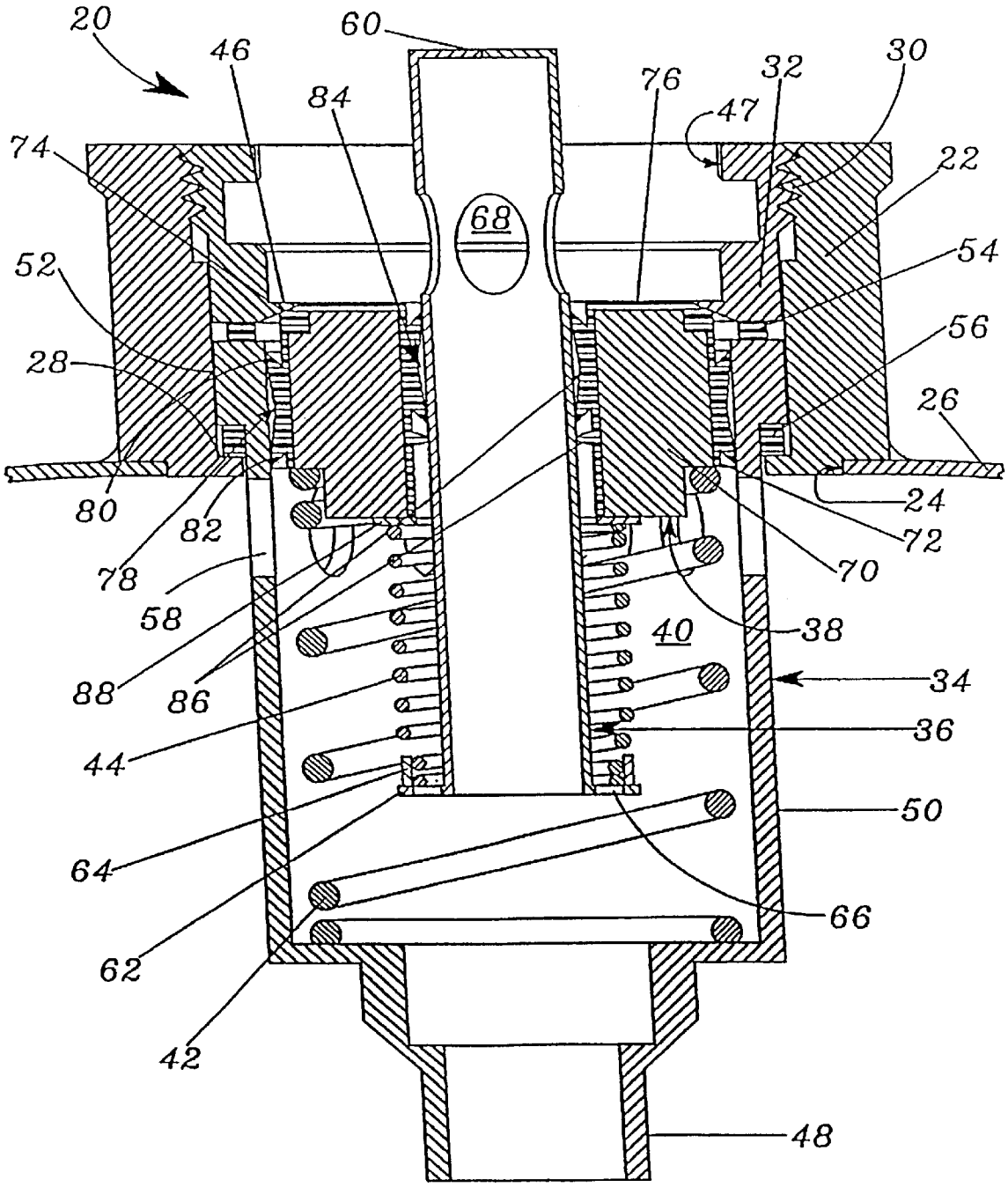
FIG. 4 is a sectional elevation view of the valve assembly of FIGS. 1–3 and illustrating the valve assembly in its pressure release or venting mode.
Figure 5:
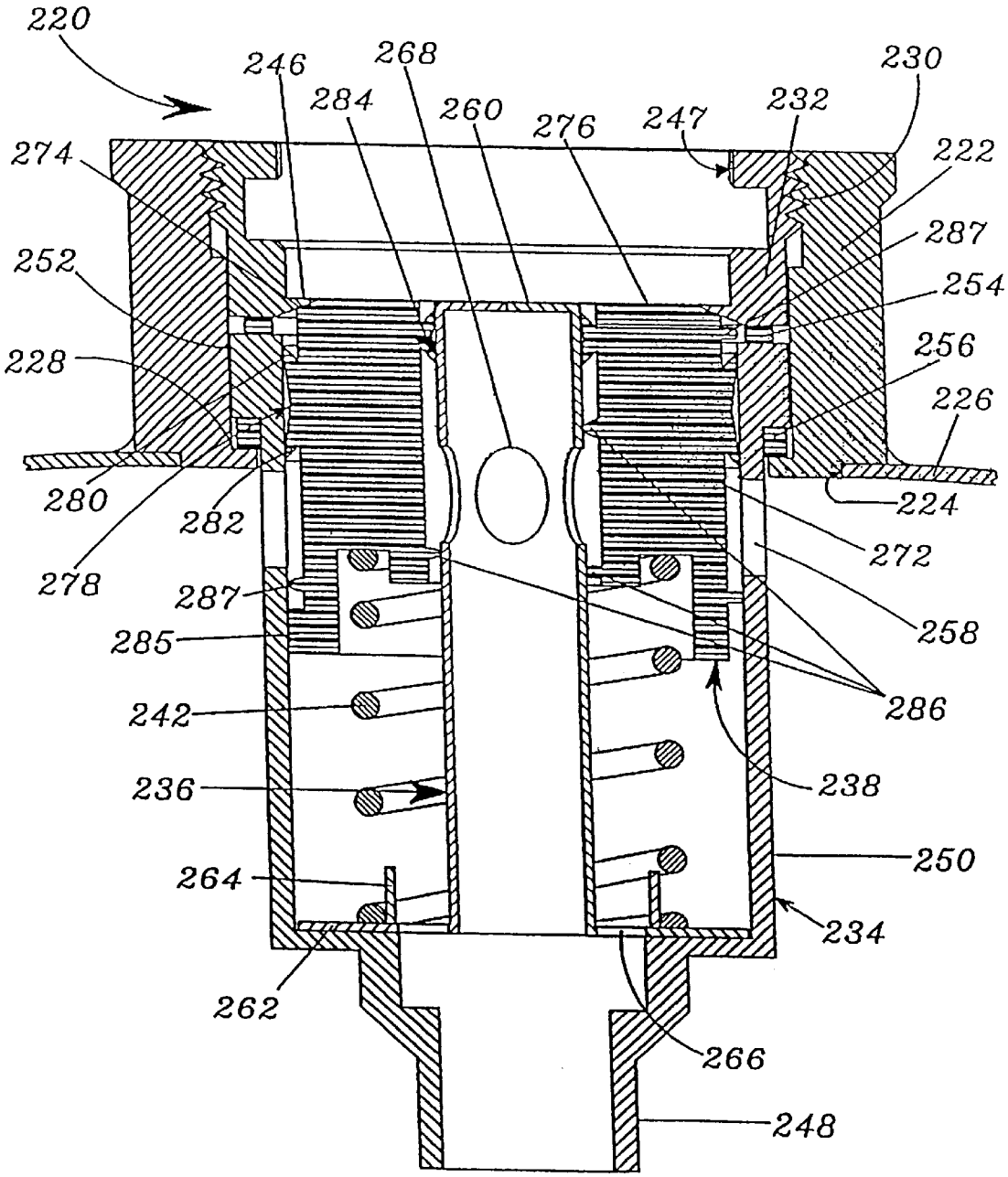
FIG. 5 is a sectional elevation view of a valve assembly according to a second embodiment of the invention and showing the valve assembly in its neutral or closed mode.

There are three modes of operation associated with the valve assembly 20 illustrated in FIGS. 1–4, namely: (1) neutral/closed (FIG. 2), (2) working/open to gas ingress and liquid egress (FIG. 3), and (3) venting/relieving excess pressure from within the container 26 (FIG. 4). A detailed discussion of each follows.

The neutral or closed position of the valve assembly 20 is illustrated in FIG. 2. The outer sealing lip 78 of the sealing ring 38 seals against the riser pipe 34 at a location above ingress/egress openings or portals 58, and the inner sealing lip 84 seals against the dispensing tower 36 at a location above the discharge portals 68. The chamfer 74 is held against the ring 46 of the housing 32 by the combined force of springs 42 and 44 and spacer 88. The arrangement of the members in this operational state differs from known assemblies in that the ingress/egress portals 58 and the discharge portals 68 share the same gas pressure, present throughout chamber 40 due to gas flow among the conical projections 86, thereby allowing the liquid in container 26 to seek its own level away from portals 58 and 68 via the inlet of the riser pipe 34. This in turn improves the coupling safety when a coupling arrangement is attached to the valve assembly 20.

Turning now to FIG. 3, the valve assembly 20 is placed in its second mode of operation in which it is open to gas ingress and liquid egress. Sealing ring 38 has been forced downwardly by a conventional fixed external coupling arrangement such as the arrangement manufactured by Perlick and marketed as Model No. MK-1. The conventional coupling arrangement includes an internal, axially displaceable, hollow spindle 90 which, when pressed downward, contacts the upper sealing face 76 of the sealing ring 38 (the ID of the spindle 90 being bored slightly if necessary to accommodate the present invention. In addition, an internal radially-extending riser stop and a separate internal V-shaped seal can if desired be added to the spindle) and forces the sealing ring 38 downwardly from the position illustrated in FIG. 2 to the position illustrated in FIG. 3. Coupling of the spindle 90 to the sealing face 76 creates (1) an ingress tube in the region located radially outside of the spindle 90 for flow of the propellant gas into the container 26, and (2) an egress tube within the spindle 90 for the flow liquid out of the container 26. The integrity of the gas and liquid separation at the circular line of contact between the spindle 90 and the sealing face 76 of the sealing ring 38 is maintained by the upward pressure of sealing spring 42. Seal integrity is enhanced further by the conical projections 86 and/or vertical ribs (not shown) fixed on the I.D. and/or O.D. walls of the sealing ring 38. As discussed above, these projections 86 serve to guide and stabilize the perpendicularly and eccentricity between the sealing ring 38, dispensing tower 36, and riser pipe 34, thereby enhancing the sealing of the outer and inner sealing lips 78 and 84 of the sealing ring 38 as they move downwardly past the ingress/egress openings or portals 58 of riser pipe 34 and the discharge openings or portals 68 of dispensing tower 36, respectively.

It is important to note that the sequence of portal overlap and exposure is timeable by setting differential relationships between the sealing lip and portal locations during valve manufacture. The valve assembly 20 therefore can be readily modified to allow the valve assembly 20 to mix more then one liquid or gas in the same chamber 40, with the differential between them being controllable by design.

When the sealing ring 38 is forced downwardly to the position illustrated in FIG. 3, (1) the ingress/egress portals 58 are exposed to propellant gas flowing into the valve assembly 20 from the region surrounding the spindle 90, and (2) the discharge portals 68 are exposed to the internal fluid discharge passage of the spindle 90. Outer sealing lip 78 prevents the propellant gas from entering the liquid at a location just below portals 58. Sealing lip 78 therefore preserves ingress propellant pressure integrity as the gas flows into the container 26. In addition, the sealing lip 78 prevents liquid from entering the ingress/egress portals 58 and thus closes the riser pipe being off to its gas connection. This in turn forces the gas now entering the container 26 through the ingress/egress portals 58 to push the liquid up into the lower inlet of the riser pipe 34, up through the center of dispensing tower 36, and out of the dispensing tower 36 through the discharge portals 68. The discharged liquid then flows through the spindle 90 and is dispensed from the system in a conventional manner.

Conversely, when there is no external coupling attached to valve assembly 20, springs 42 and 44 return the sealing ring 38 to its neutral or closed mode as illustrated in FIGS. 2 and 4, thereby containing liquid and gas within container 26 for transport. The inventive valve assembly 20 therefore exhibits the same benefit as previously-known valve assemblies which also contain liquid and gas within their containers for transport when they are closed.

However, unlike conventional valve assemblies, the inventive valve assembly 20 also is capable of operating in a pressure relief mode. Pressure relief is desirable because the contents of the container 26 can be exposed to thermal agitation such as fire or mechanical agitation such as excessive shaking. External agitation may cause gas pressure within the container 26 to build-up to a level that is high enough to breach the container's integrity with devastating consequences. This potential overpressurization is avoided by permitting the valve assembly 20 to assume the mode illustrated in FIG. 4 in which pent-up gas pressure within the container 26 overcomes the seal between the inner sealing lip 84 of the sealing ring 38 and the dispensing tower 36. That is, gas pressure acting on the dispensing tower 36 forces the tower 36 upwardly against the spring 44 to a position where portals 68 vent. Since the sealing ring 38 is held from upward movement by the ring 46 of the housing 32, the discharge or egress portals 68 of the discharge tower 36 move beyond the inner sealing lip 84 to permit excess pressure within the container to flow past the riser pipe 34, through ingress/egress portals 58, through the dispensing tower 36, and out of the valve assembly 20 through the discharge portals 68. It should be noted that, because upward movement of the dispensing tower 36 is resisted primarily by the spring 44, the threshold pressure above which relief or venting occurs is determined by the strength of the spring 44 and can be set by selecting a spring of a designated strength. In those instances in which overpressurization results from thermal agitation caused by fire or the like, pressure release can be accelerated through thermal degradation of the insert 70 and consequent ejection of the entire sealing ring 38 from the valve assembly 20.

The valve assembly could take many forms from that illustrated and described above without departing from the basic principals of operation. A first alternative construction of the inventive valve assembly will now be described.

3. Description of Second Embodiment

Referring to FIGS. 5–8, components of the valve assembly 220 of the second embodiment corresponding to components of the valve assembly 20 of the first embodiment (illustrated in FIGS. 1–4) are designated by the same reference numerals, incremented by 200. The valve assembly 220 of FIGS. 5–8 differs from the valve assembly 20 of FIGS. 1–4 in that (1) the sealing ring 238 is of slightly different design, (2) one of the springs of the first embodiment has been eliminated, and (3) dispensing tower 236 has been redesigned to accommodate the elimination of one of the springs. These discrepancies from the first embodiment will now be detailed.

Sealing ring 238 is configured for sliding movement in the chamber 240 in the same manner as the sealing ring 38 of the first embodiment. However, this sealing ring 238, unlike the sealing ring 38 of the first embodiment, is formed of a single unitary polymer member and thus lacks the rigidifying insert of the first embodiment. Additional centering projections 287 also are provided on the outer radial periphery of a sealing ring 238, and vertical centering ribs 285 are provided on the outer radial periphery to help guide the sealing ring 238 as it moves along the valve cup or riser pipe 234.

The sole spring 242 of the second embodiment is designed to interact with the elastomeric sealing ring 238 to perform the combined functions of both springs 42 and 44 of the first embodiment. The spring 242 urges against the bottom surface of the sealing ring 238 at its upper end and against the annular flange 262 of the dispensing tower 236 at its lower end. The generally triangular projections 264 of this flange 262 are spaced further towards the inner edge of the flange 262 when compared to the corresponding projections 64 of the first embodiment to accommodate the larger spring. Finally, the relative positional relationship between the sealing lips 278 and 284, the ingress/egress openings or portals 258, and the discharge openings or portals 268 has been varied slightly to accommodate the revised sealing ring configuration.

Operation of the valve assembly 220 of the second embodiment is essentially identical to the operation of the valve assembly 20 of the first embodiment. Hence, when the valve assembly 220 is in its neutral closed mode illustrated in FIG. 5, the outer sealing lip 278 is located above the ingress/egress portals 258 and sealed against the internal surface of the riser pipe 234, the inner sealing lip 284 is located above the discharge portals 268 and sealed against the external surface of the dispensing tower 236, and the chamfer 274 is sealed against the ring 246. Accordingly, the entire portion of the chamber 240 beneath the sealing ring 238 is subject to whatever gas pressure exists within the container 226, and egress of fluids from the dispensing tower 236 is prohibited by the inner sealing lip 284.

Figure 6:
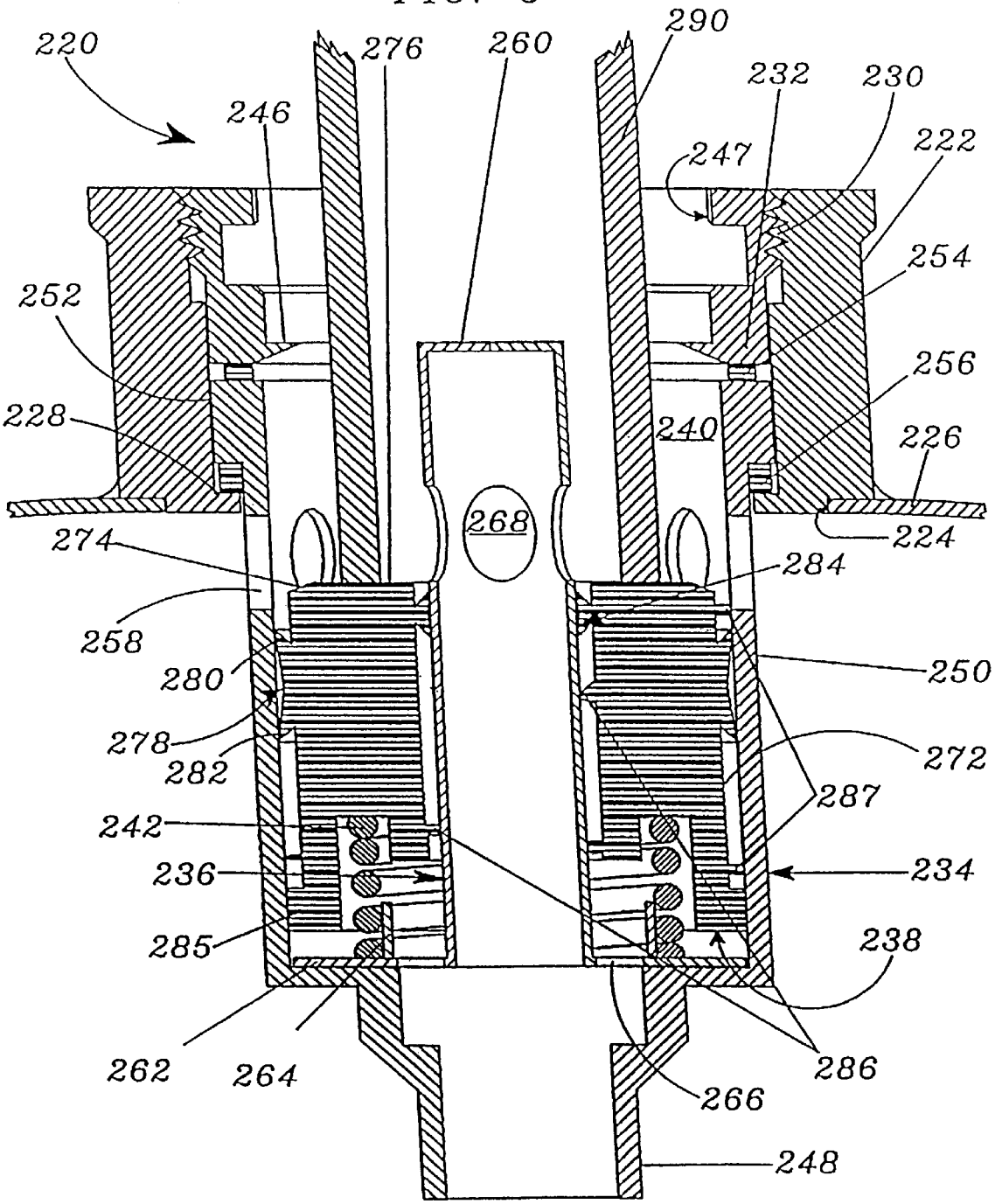
FIG. 6 is a sectional elevation view of the valve assembly of FIG. 5 and illustrating the valve assembly in its normal or working mode.

In the working mode, shown in FIG. 6, the sealing ring 238 of the second embodiment is forced downwardly by a hollow spindle 290 against spring 242 to the illustrated position in which the outer and inner sealing lips 278 and 284 are positioned beneath the respective rows of portals 258 and 268. The integrity of the gas and liquid separation at the interface between the spindle 290 and the sealing face 276 is maintained by the upward pressure of control spring 242. The inner and outer conical projections 286 and 287 and/or vertical ribs 285, fixed on the I.D. and/or O.D. walls of sealing ring 238, guide and stabilize the perpendicularly and eccentricity between the sealing ring 238, the dispensing tower 236, and the riser pipe 234, thereby enhancing the sealing of the lips 278 and 284 as they move downwardly past the discharge portals 268 of dispensing tower 236 and the ingress/egress portals 258 of riser pipe 234. As in the first embodiment, the sequence of portal blockage and opening is timeable by setting or altering the differential relationships between the sealing lip and portal locations. The operation of the valve assembly 220 in its working mode is otherwise the same as the operation of the valve assembly 20 of the first embodiment in its working mode and, accordingly, will not be detailed.

Figure 7:
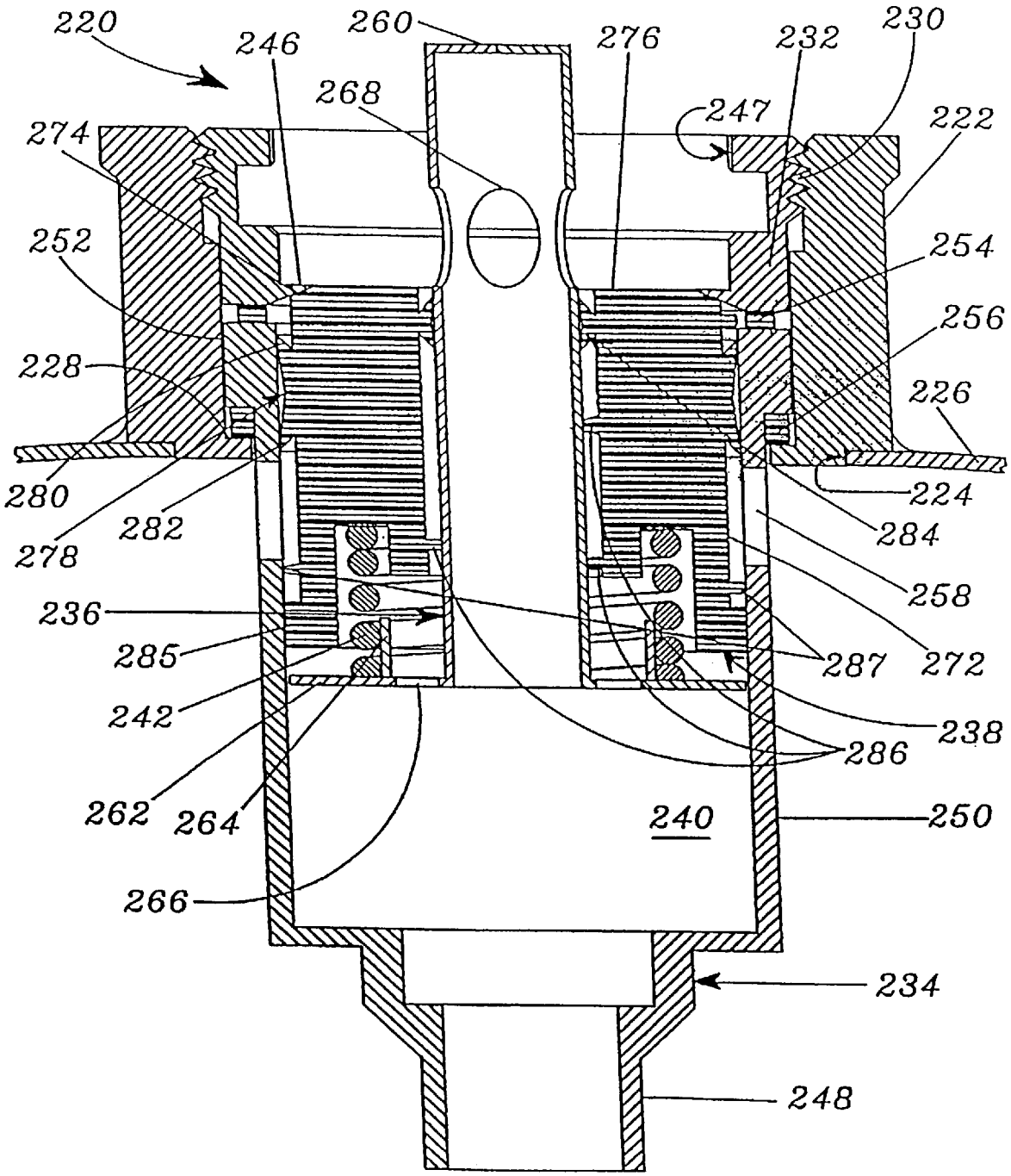
FIG. 7 is a sectional elevation view of the valve assembly of FIGS. 5 and 6 and illustrating the valve assembly in its pressure release or venting mode.
Figure 8:
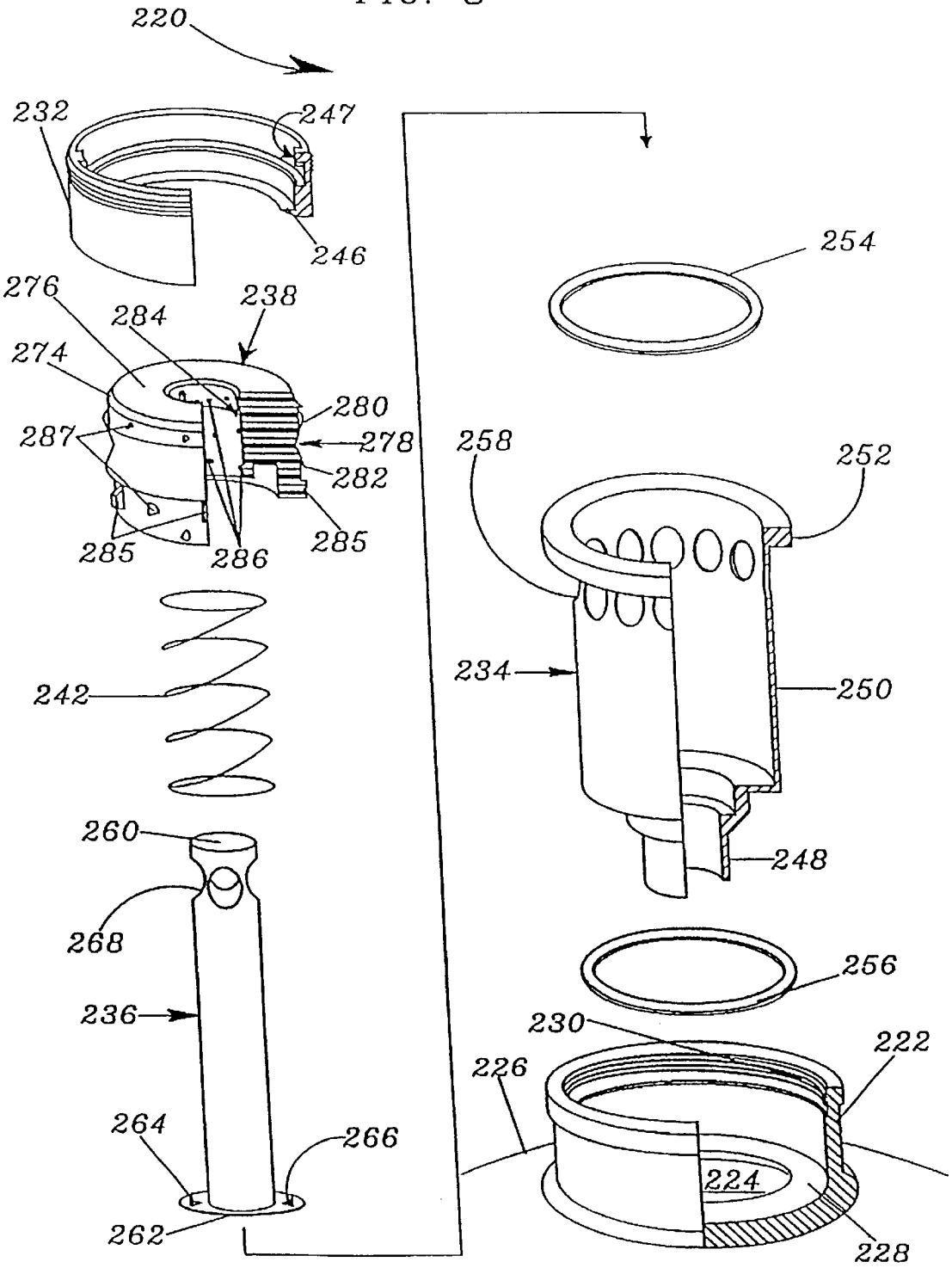
FIG. 8 is an exploded perspective view of the valve assembly of FIGS. 5–7.

Conversely, when, as illustrated in FIG. 7, there is no external coupling attached to the valve assembly 220, the sole spring 242 of the assembly returns the sealing ring 238 to its neutral or closed state, thereby containing liquid and gas within the container 226 for transport. However, if the contents of the container 226 become overpressurized due, e.g., to thermal agitation, the excess pent-up pressure will force dispensing tower 236 upwardly against the force of control spring 242 to the illustrated position venting said pressure through discharge portals 268 which are now located above the inner sealing lip 284 of the sealing ring 238, in the same manner detailed above in connection with the first embodiment.

4. Description of Third Embodiment

Turning now to FIGS. 9–12, a valve assembly 320 constructed in accordance with a third embodiment of the invention is illustrated which is similar to the valve assembly 220 of the second embodiment. Components of the third embodiment corresponding to those of the second embodiment are, accordingly, designated by the same reference numerals, incremented by 100.

The valve assembly 320 of the third embodiment differs from the valve assembly 220 of the second embodiment primarily in that the dispensing tower 336 takes the form of an imperforate standpipe assembly rather than a perforated hollow pipe. The dispensing tower 336 therefore includes an upper head 361 of relatively large diameter and a lower shank 363 of relatively small diameter separated by a downwardly facing shoulder 369 on the head 361. An annular plate 362 is affixed to the bottom end portion of the shank 363 and serves the same function as the annular flange 262 of the second embodiment, namely, it supports the spring 342 and has projections 364 bend upwardly therefrom to guide the spring 342 and to form opening 366 for fluid flow through the plate 362. The ribs 385 are mounted on the shank 363 rather than the sealing ring 338 to illustrate that centering devices could be mounted on either or both members.

The sealing ring 338 of the third embodiment differs from the sealing ring 238 of the second embodiment in that its inner portion is modified to cooperate with the standpipe or dispensing tower 336. Specifically, as is clearly illustrated in the drawings, the inner peripheral surface of the sealing ring 338 is stepped so as to present an axial shoulder or sealing face 377 on which the mating shoulder 369 of the dispensing tower 336 sealingly rests when the valve assembly 320 is in its neutral or closed mode illustrated in FIG. 9. In the other two modes of operation, illustrated in FIGS. 10 and 11, respectively, sealing face 377 is spaced from the shoulder 369 of the dispensing tower 336 to permit fluid flow therepast and out of the valve assembly 320.

The operation of the valve assembly 320 of the third embodiment is generally the same as the operation of the valve assembly 220 of the second embodiment. The sealing ring 338 moves downwardly within the chamber 340, under the action of a spindle 390 of a coupling head and against the biasing force of the spring 342, from its neutral or closed position illustrated in FIG. 9 to its working or open position illustrated in FIG. 10. The integrity of the gas and liquid separation at the spindle-to-sealing ring coupling is maintained before and after this motion by the upward pressure of control spring 342 and by conical projections 386 and 387 and/or vertical ribs 385, which help stabilize the perpendicularly and eccentricity between the sealing ring 338, dispensing tower 336, and riser pipe 334, thereby enhancing the sealing of the sealing lip 378 as the sealing ring 338 moves downwardly past the ingress/egress portals 358 of the riser pipe 334. Movement of the sealing ring 338 relative to the dispensing tower 336 causes the sealing face 377 of the sealing ring 338 to separate from the mating shoulder 369 on the dispensing tower 336, thereby permitting liquid to flow between the sealing ring 338 and the dispensing tower 336, out of the valve assembly 320, and into the egress tube formed by the spindle 390. As in the previous embodiments, this is a sequence that is timeable by altering the differential relationships between the sealing lip and portal and shoulder locations. The operation of the valve assembly 320 in its working mode is otherwise the same as in the first and second embodiments and, accordingly, will not be detailed.

Figure 9:
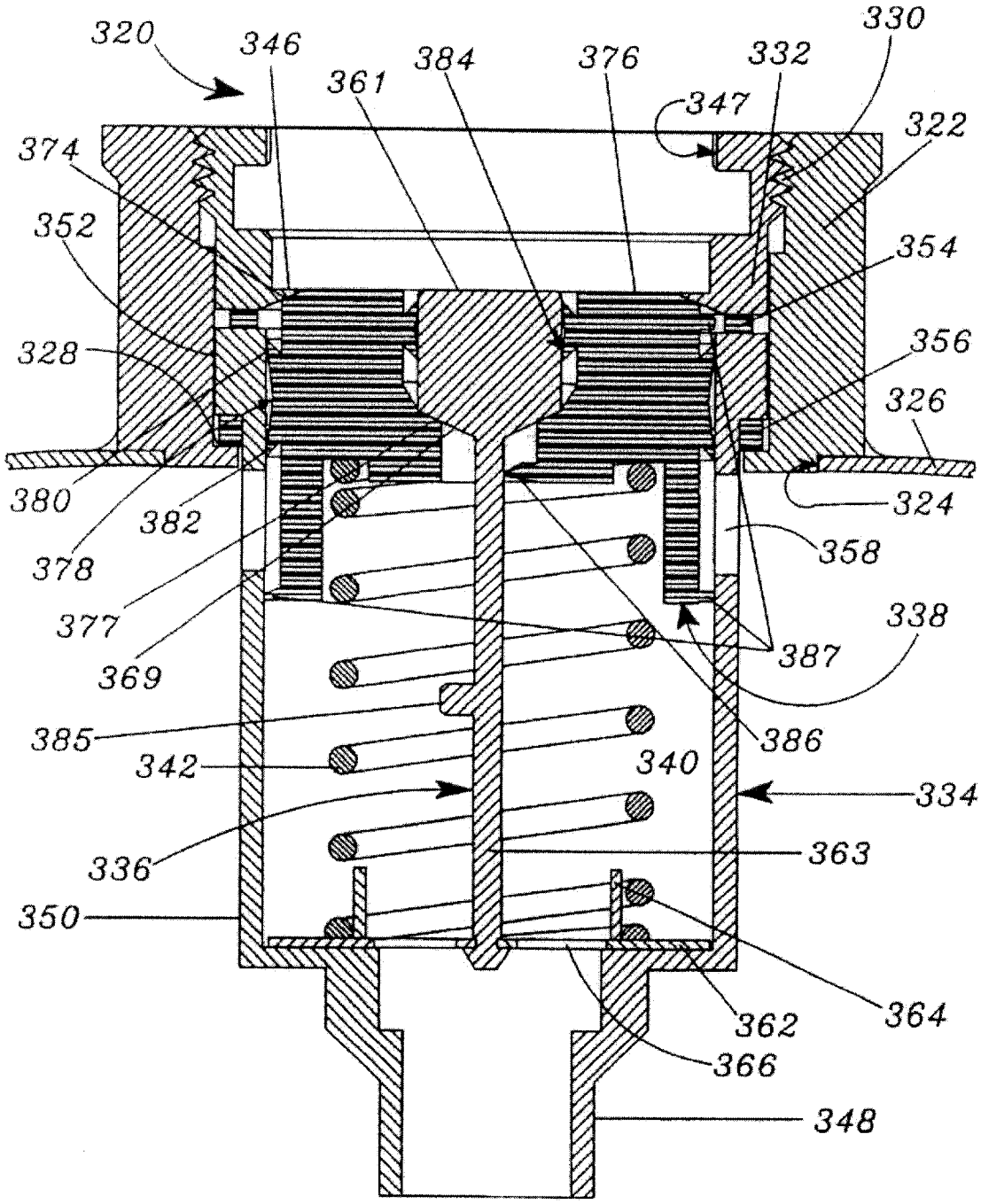
FIG. 9 is a sectional elevation view of a valve assembly according to a third embodiment of the invention and showing the valve assembly in its neutral or closed mode.
Figure 10:
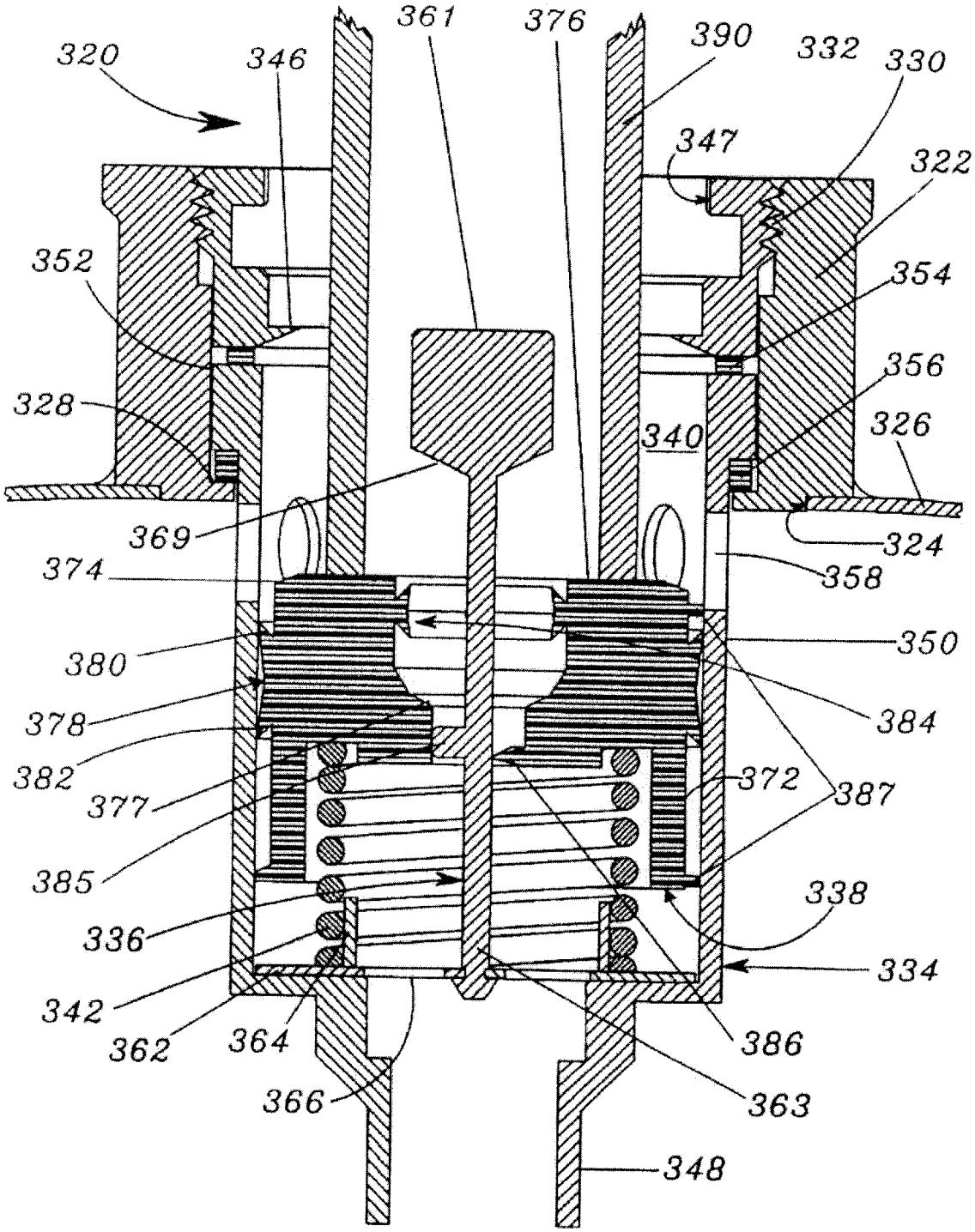
FIG. 10 is a sectional elevation view of the valve assembly of FIG. 9 and showing the valve assembly in its normal or working mode.
Figure 11:
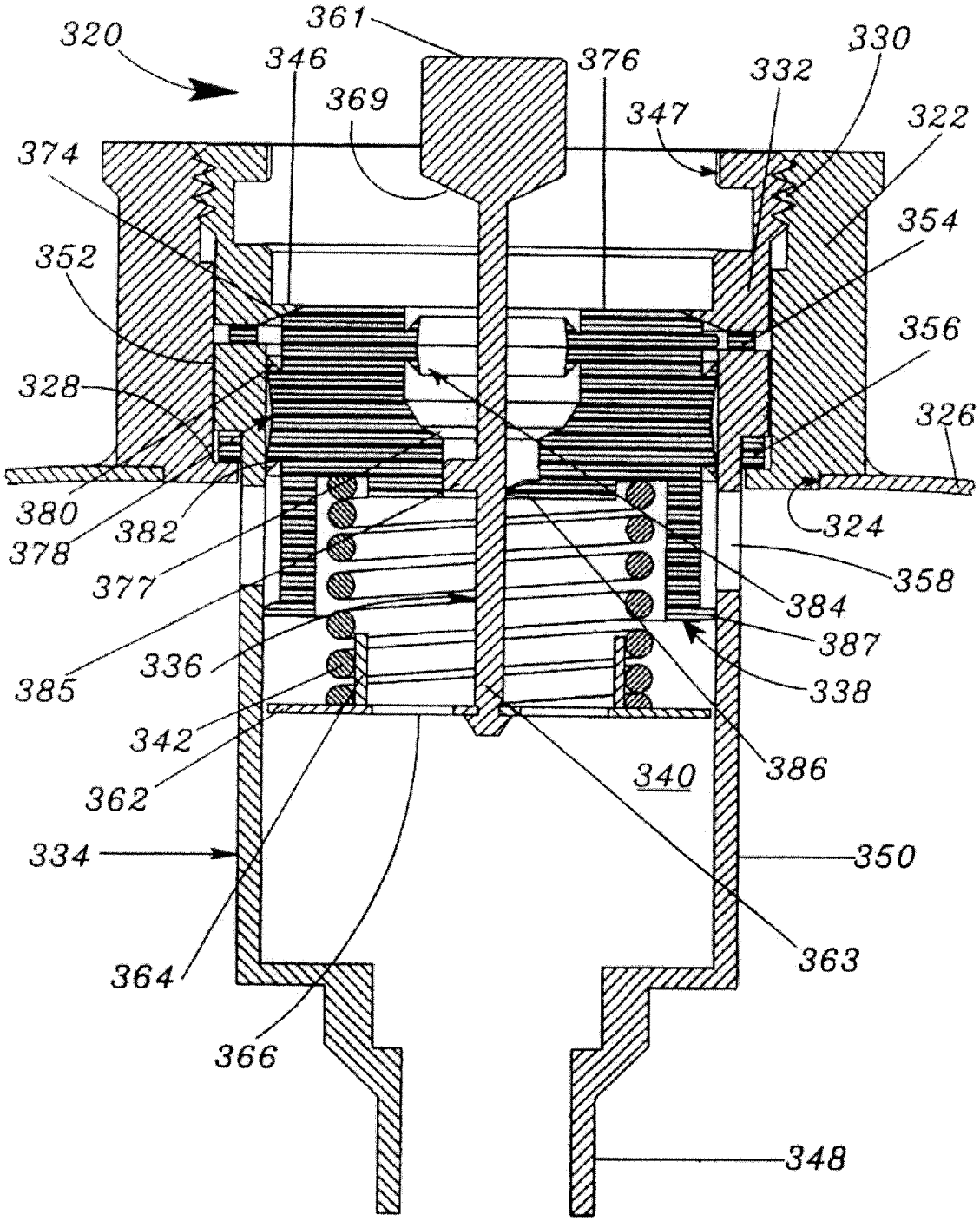
FIG. 11 is a sectional elevation view of the valve assembly of FIGS. 9 and 10 and showing the valve assembly in its pressure release or venting mode.
Figure 12:
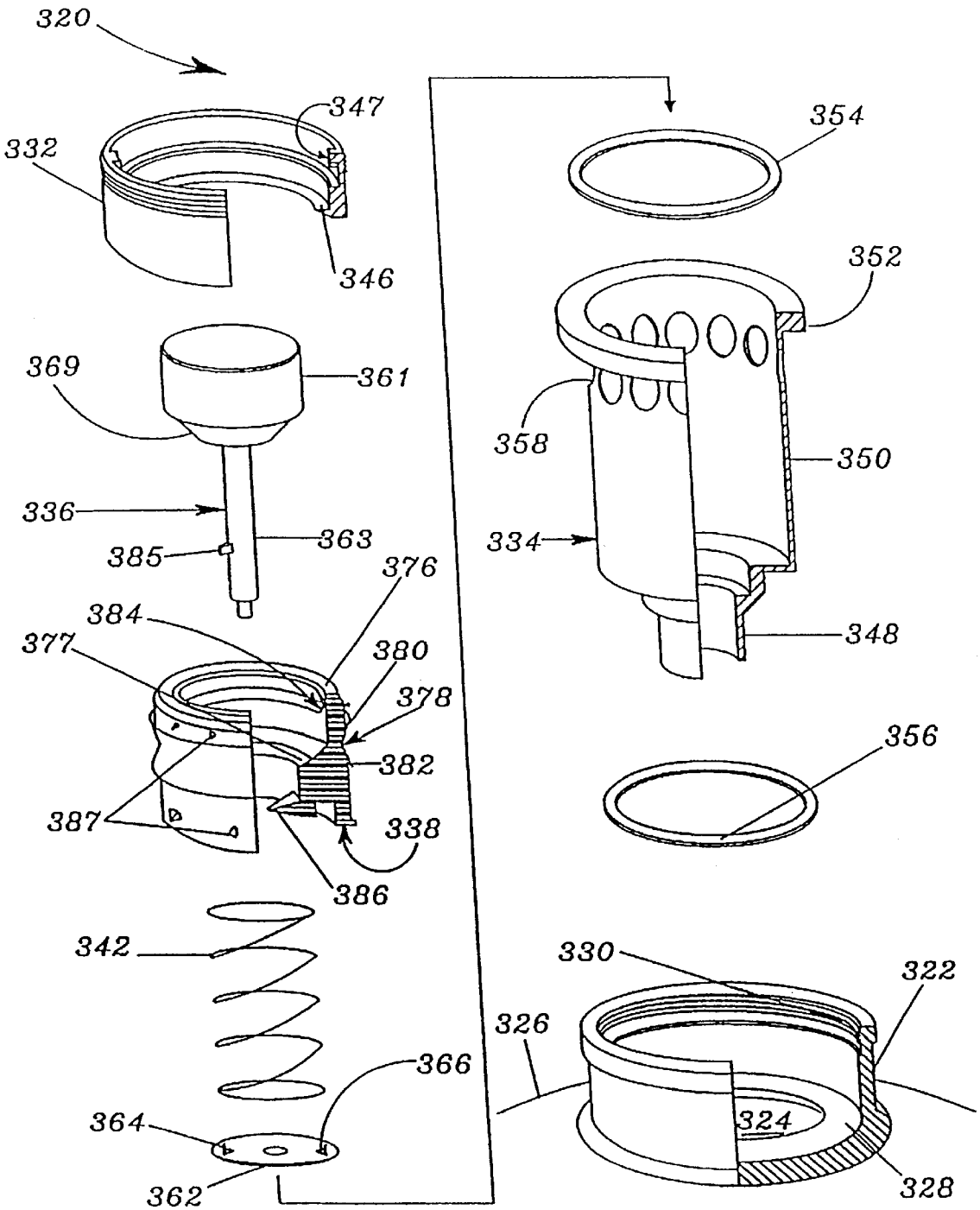
FIG. 12 is an exploded perspective view of the valve assembly of FIGS. 9–11.

When, as illustrated in FIGS. 9 and 11, there is no external coupling attached to valve assembly 320, spring 342 returns the sealing ring 338 to its neutral or closed state, thereby containing liquid and gas within container 326 for transport. In the event of pressure build-up within the container 326 due to the imposition of thermal or mechanical agitation, excess pressure in the container 326 will force the dispensing tower 336 upwardly, against the biasing force of control spring 342, so that (1) the bottom horizontal plane or shoulder 369 of the large diameter or head 361 of the post or dispensing tower 336 moves past the horizontal plane or sealing face 377 of the sealing ring 338. The pressurized gas in the container 326 is then free to vent through the ingress/egress portals 358 of riser pipe 334, then through the center of the sealing ring 338, past the open egress pathway between the sealing ring 338 and the dispensing tower 336, and out of the valve assembly 320.

5. Description of Fourth Embodiment

Still another embodiment of the invention is illustrated in FIGS. 13–16. The valve assembly 420 constructed in accordance with this fourth embodiment differs from the valve assembly 20 of the first embodiment primarily in that, in a pressure relief or venting mode, the dispensing tower 436 is held stationary and the sealing ring 438 moves upwardly to achieve the desired venting. Several relatively minor structural changes are made to the valve assembly 420 to permit this alternate operation. However, the valve assembly 420 of this embodiment is for the most part similar in construction and operation of the valve assembly 20 of the first embodiment. Components of this embodiment corresponding to components of the first embodiment are, accordingly, designated by the same reference numerals, incremented by 400. Those features which are altered with respect to the first embodiment will now be detailed.

Figure 13:
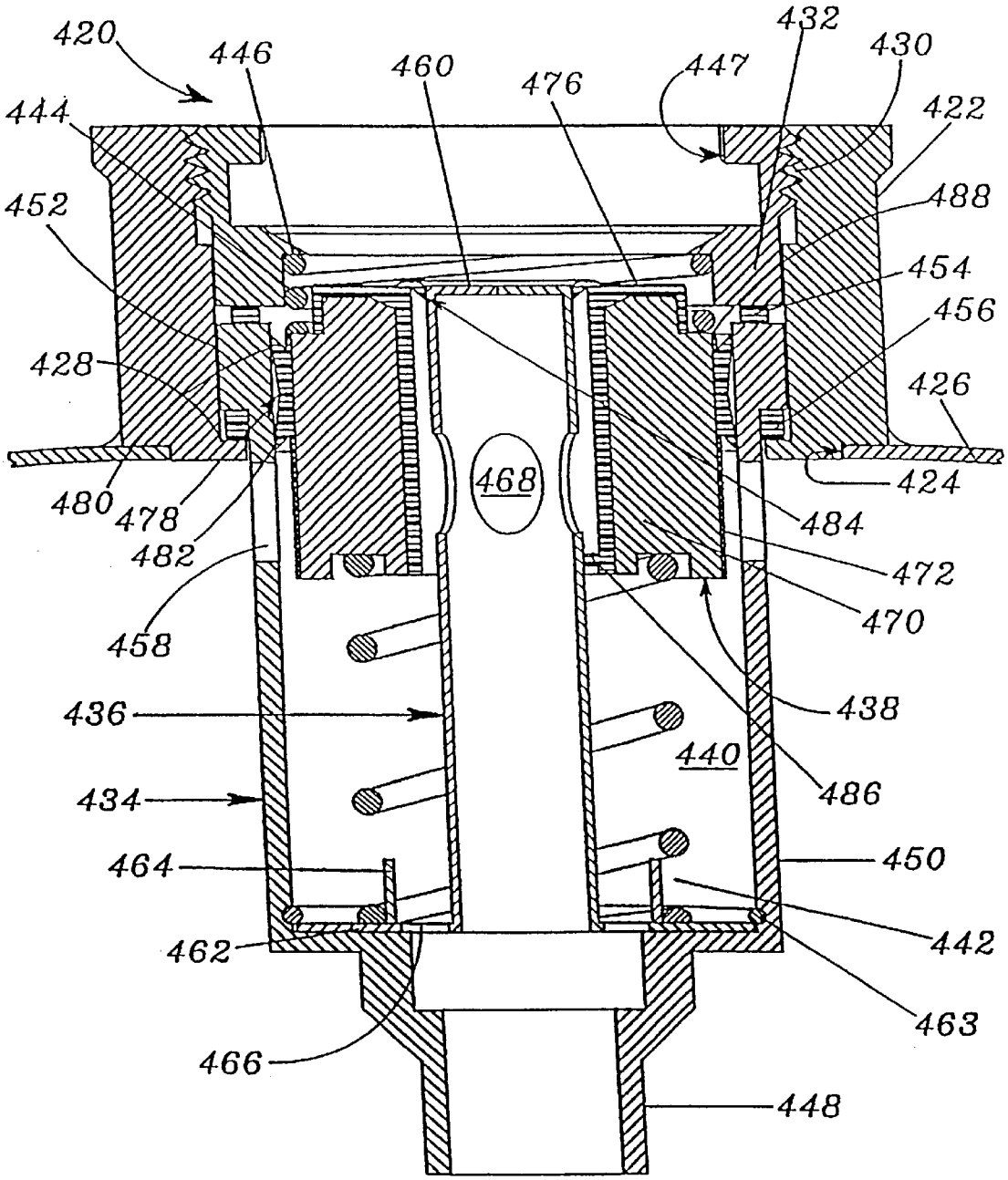
FIG. 13 is a sectional elevation view of a valve assembly according to a fourth embodiment of the invention and showing the valve assembly in its neutral or closed mode.

First, the sealing ring 438 does not engage the ring 446 of the housing 432 when the valve assembly 420 is in its neutral or closed position illustrated in FIG. 13. Rather, the sealing ring 438 is held in a neutral position in which it is spaced between the housing ring 446 and the ingress/egress portals 458 of the riser pipe 434 under the balancing action of the sealing spring 442 and a second, venting spring 444 acting against the sealing spring 442. The venting spring 444 is positioned axially between the housing ring 446 and the sealing ring 438 and is configured to apply a downward biasing force on the sealing ring. Contact between an intermediate axial portion of the sealing ring and the spring 444 is made possible by configuring the sealing ring 438 such that it is somewhat longer than the sealing ring 38 of the first embodiment and such that it has a stepped outer peripheral surface so as to present an upwardly facing shoulder 488 on which the spring 444 rests.

Second, the bottom flange or ring 462 of the dispensing tower 436 is larger in diameter than the flange or ring of the first embodiment and is held in its illustrated position by a retaining ring 463 mounted in the riser pipe 434, and/or protrusions within riser pipe 434.

The operation of the valve assembly 420 constructed in accordance with the fourth embodiment will now be described.

In the neutral or closed position of the valve assembly 420 illustrated in FIG. 13, the outer sealing lip 478 of the sealing ring 438 seals against the riser pipe 434 at a location above ingress/egress portals 458, and the inner sealing lip 484 seals against the dispensing tower 436 at a location above the discharge portals 468. The sealing ring 438 is held in its illustrated neutral position by the opposing forces of the upper venting spring 444 and the lower sealing spring 442. As in the previous embodiments, the ingress/egress portals 458 and discharge portals 468 share the same gas pressure, present throughout chamber 440 due to the flow of gas among the projections 486, thereby allowing the liquid in container 426 to seek its own level away from portals 458, which in turn improves the coupling safety when a coupling arrangement is attached to the valve assembly 420.

Figure 14:
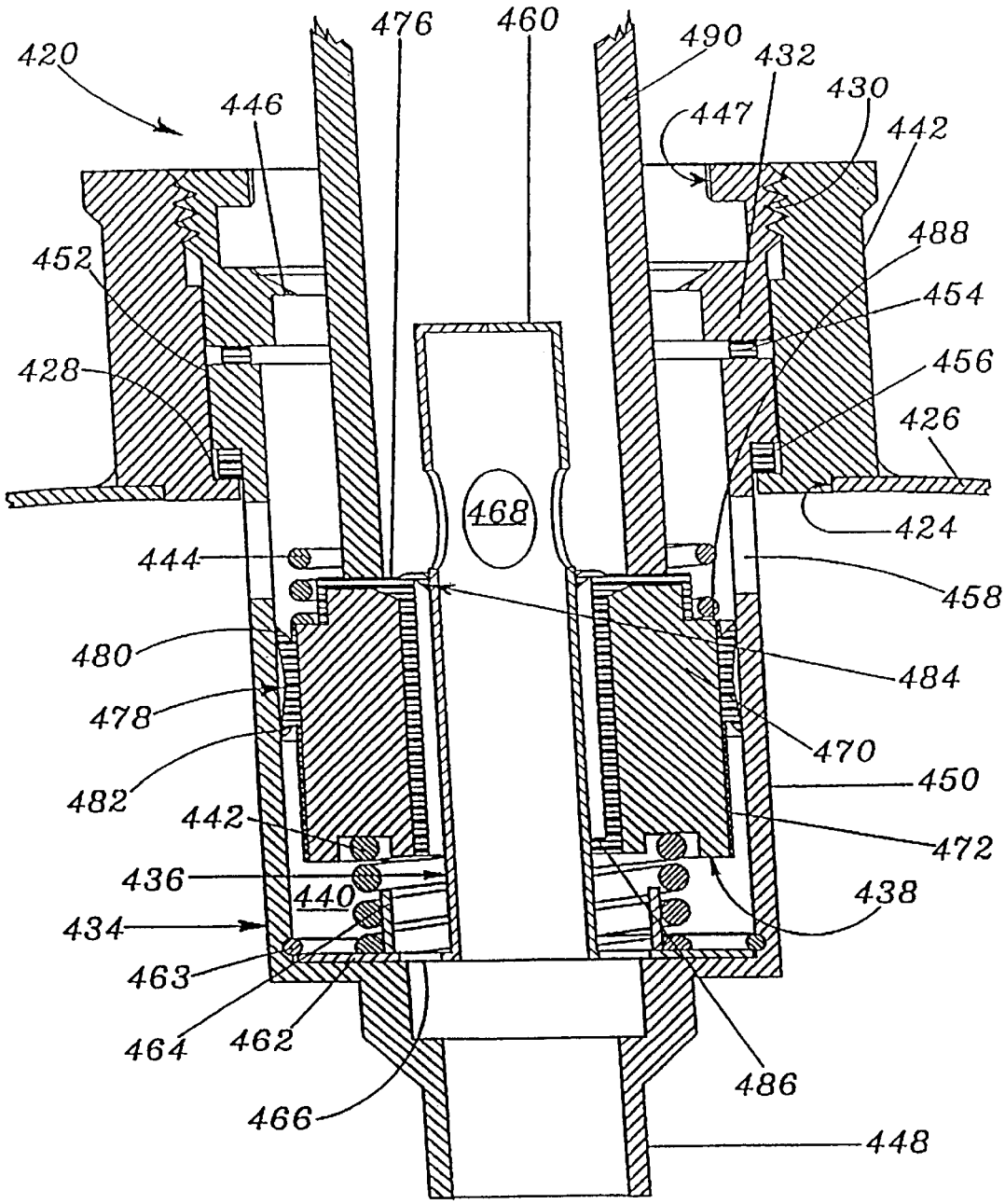
FIG. 14 is a sectional elevation view of the valve assembly of FIG. 13 and showing the valve assembly in its normal or working mode.
Figure 15:
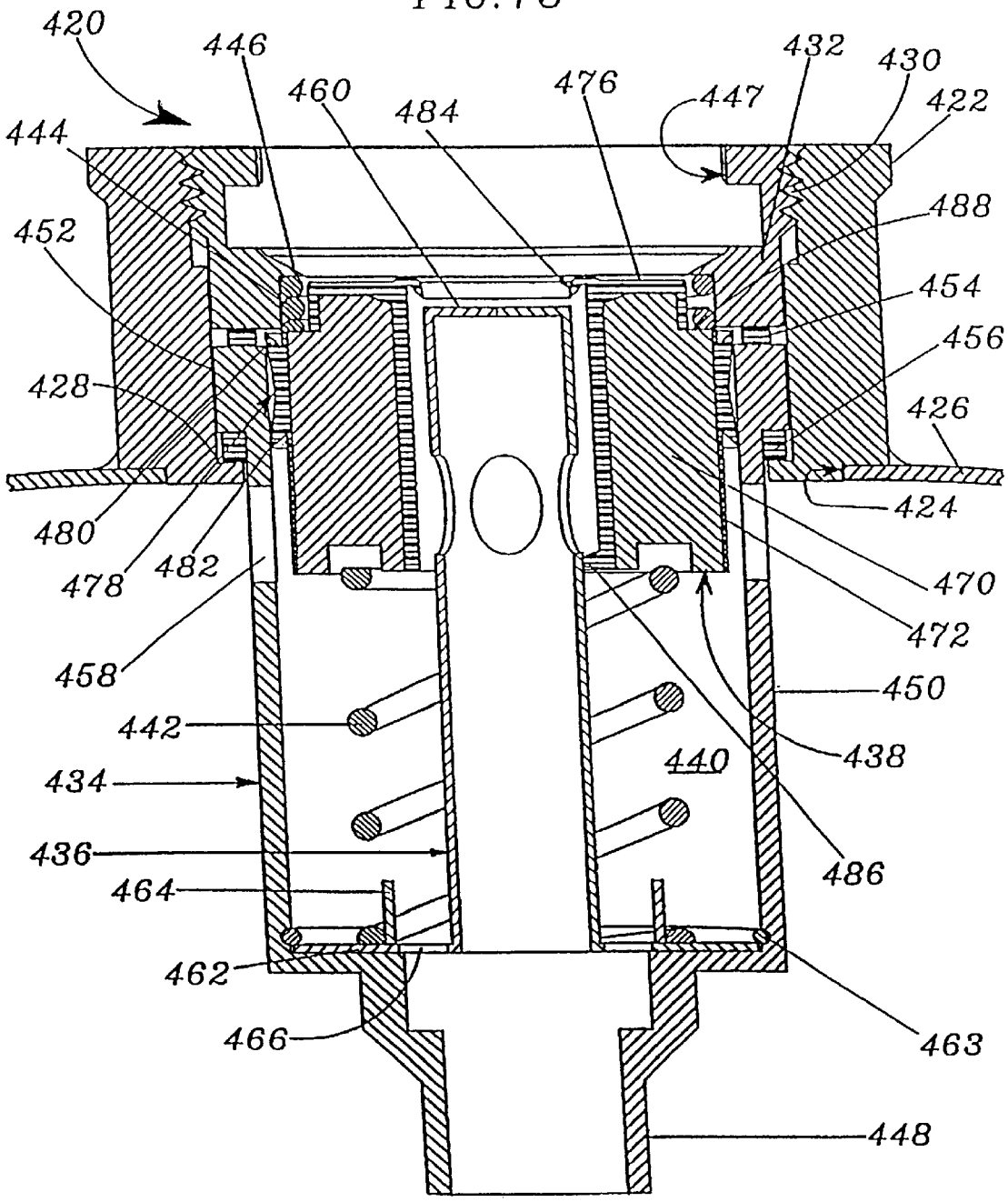
FIG. 15 is a sectional elevation view of the valve assembly of FIGS. 13 and 14 and showing the valve assembly in its pressure release or venting mode.
Figure 16:
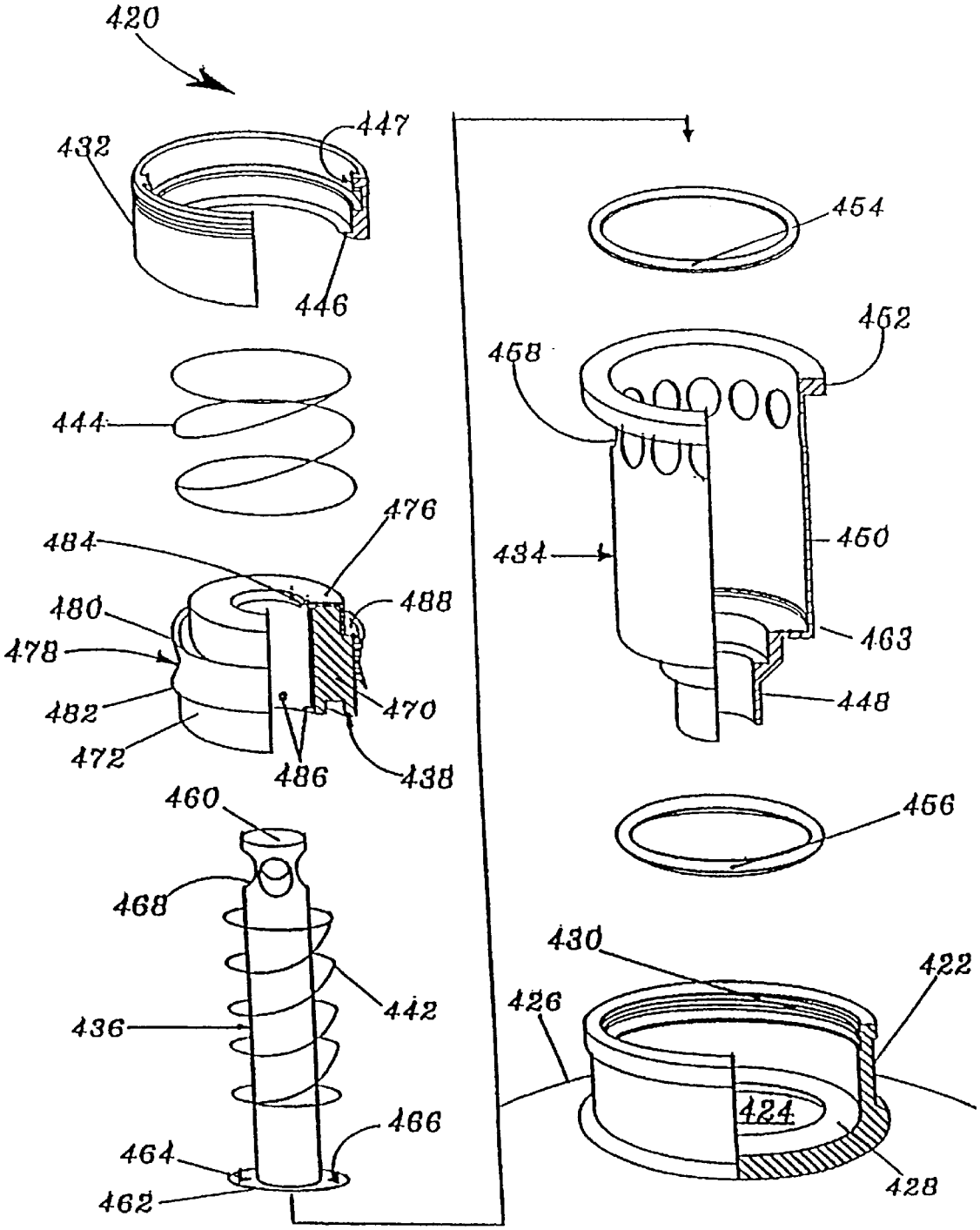
FIG. 16 is an exploded perspective view of the valve assembly of FIGS. 13–15.

Turning now to FIG. 14, the valve assembly 420 is placed in its working mode of operation in which it is open to gas ingress and liquid egress by driving the sealing ring 438 downwardly, against the force of the spring 442, using a spindle 490 of a conventional fixed external coupling arrangement. The spindle 490 comes into contact with the upper sealing face 476 of the sealing ring 438 and forces the sealing ring 438 downwardly from the position illustrated in FIG. 13 to the position illustrated in FIG. 14. As in the previous embodiments, coupling of the spindle 490 to the sealing face 476 creates an ingress tube radially outside of the spindle 490 for flow of the propellant gas into the container 426, and an egress tube within the spindle 490 for the flow liquid out of the container 426. The integrity of the gas and liquid separation at the circular line of contact between the spindle 490 and the sealing face 476 is maintained by the upward pressure of sealing spring 442. Seal integrity is enhanced further by the conical projections 486 and/or vertical ribs (not shown in this embodiment), fixed on the I.D. and/or O.D. walls of the sealing ring 438, in the manner discussed above in connection with the previous embodiments.

When the sealing ring 438 is forced downwardly to the position illustrated in FIG. 14, (1) the ingress/egress portals 458 are exposed to propellant gas flowing into the valve assembly 420 from the region surrounding the spindle 490, and (2) the discharge portals 468 are exposed to the internal fluid discharge passage of the spindle 490. Outer sealing lip 478 prevents the propellant gas from entering the liquid at a location just below the portals 458 of riser pipe 434. Sealing lip 480 therefore preserves ingress propellant pressure integrity as pressurized gas flows into the container 426, and sealing lip 482 also prevents the liquid from entering the portals 458 of riser pipe 434, resulting in the riser pipe 434 being closed off to its gas connection. This in turn forces the gas now entering the container 426 through the portals 458 of riser pipe 434 to push the liquid up the inlet of the riser pipe 434, up through and about the center of dispensing tower 436, enhancing the seal of sealing lip 484 and then out of the dispensing tower through the discharge portals 468. The discharged liquid then flows through the spindle 490 and is dispensed from the system in a conventional manner.

Conversely, when there is no external coupling attached to valve assembly 420, springs 442 and 444 return the sealing ring 438 to its neutral or closed mode as illustrated in FIG. 13, thereby containing liquid and gas within container 426 for transport. If gas pressure within the container 426 increases to excessive levels, the valve assembly 420 assumes the mode illustrated in FIG. 15 in which pent-up gas pressure within the container 426 overcomes the seal between the inner sealing lip 484 of the sealing ring 438 and the dispensing tower 436. That is, gas pressure acting on the sealing ring 438 forces the sealing ring 438 upwardly against the biasing force of the upper spring 444. Since the dispensing tower 436 is held from upward movement by the ring 463 of the riser pipe 434, the inner sealing lip 484 of the sealing ring 438 moves beyond the upper end 460 of the dispensing tower 436 to expose the discharge portals or openings 468 of the dispensing tower to the ambient atmosphere. Excess pressure within the container 426 can then flow past the riser pipe 434, through ingress/egress portals 458, through the dispensing tower 436, and out of the valve assembly 420 through the discharge portals 468.

6. Description of Fifth Embodiment

Still yet another embodiment of the invention is illustrated in FIGS. 17–21. Valve assembly 520 constructed in accordance with this fifth embodiment differs from the valve assembly 320 of the third embodiment primarily in that the dispensing tower 536 is movable downwardly to accommodate the flow of liquid in the normal dispensing mode between sealing ring 538 and the dispensing tower 536. Several structural changes are made to the valve assembly 520 to permit this alternative operation and to achieve other advantages. However, the valve assembly 520 of this embodiment is, for the most part, similar in construction and operation to the valve assembly 320 of the third embodiment. Components of this embodiment corresponding to components of the third embodiment are, accordingly, designated by the same reference numerals, incremented by 200. These components include a valve housing 532, a stationary riser pipe 534, a dispensing tower 536, and a sealing ring 538 which is disposed in an annular chamber 540 formed between the dispensing tower 536 and the riser pipe 534. The valve assembly 520 also includes first and second springs 544 and 542 and an O-ring seal 556. Also as in the previous embodiments, the valve assembly 520 is configured for fitting into a standard stub 522 of a container 526. Those features which are altered with respect to the third embodiment will now be detailed, the remaining features being discussed only to the extend necessary to facilitate an understanding of the operation of the valve assembly 520.

As in the previous embodiments, the riser pipe 534 is mounted on an annular shoulder 528 of the stub 522 and extends into an inlet 524 formed in the container 526.

However, the riser pipe 534 differs from the riser pipes of the previous embodiments primarily in that it is tapered inwardly as illustrated so that the lower end of the sealing ring 538 seals against the riser pipe 534 as the sealing ring 536 moves downwardly during valve actuation. Moreover, and as discussed below, the riser pipe 534 is sealed to the valve housing 532 so that the valve housing 532, in effect, forms an extension of the riser pipe.

The dispensing tower 536 differs significantly from the dispensing towers of the previous embodiments.

For instance, rather than being of one-piece construction, it is formed from two parts, namely 1) a plastic body 535 and 2) a metal contact ball 537. The contact ball 537, preferably formed from stainless steel, is inserted into a socket 539 formed in the upper end of the body 535. The ball 537 projects just above the uppermost surface of the body 535 and presents a rigid contact surface for a lower protrusion 592 of a spindle 590 when the spindle 590 is inserted into the valve assembly 520 as detailed below in conjunction with FIG. 18. The ball 537 serves to maintain the circular shape of the uppermost portion of the body 535 and also prevents wear and tear to the dispensing tower 536 which might otherwise occur from coming into contact with the spindle 590.

The body 535 could be formed from any dimensionally stable food-grade material, and preferably is formed from a food-grade plastics materials for cost and weight considerations. An especially preferred material is polysulfone, which is manufactured by Amoco Corp. Polysulfone is preferred because it is rigid, durable, and easy to fabricate. The material also has very closed cell surfaces which inhibit contamination and which make the material ideally suited for use in food processing equipment. In addition, the material is capable of withstanding temperatures from −150 degrees Fahrenheit to +300 degrees Fahrenheit. The body 535 includes an upper annular shoulder 561 which is biased into sealing engagement with the sealing ring 538 via the spring 542. Spring 542 abuts an intermediate radial shoulder 533 on the body 535 at its upper end and abuts an internal flange 531 of the riser pipe 534 at its lower end. A portion of the body 535, extending from the ball 537 to the intermediate shoulder 533, is in the shape of a circular hourglass conic so that both ends of this portion are wider than a center of this portion.

Figure 21:
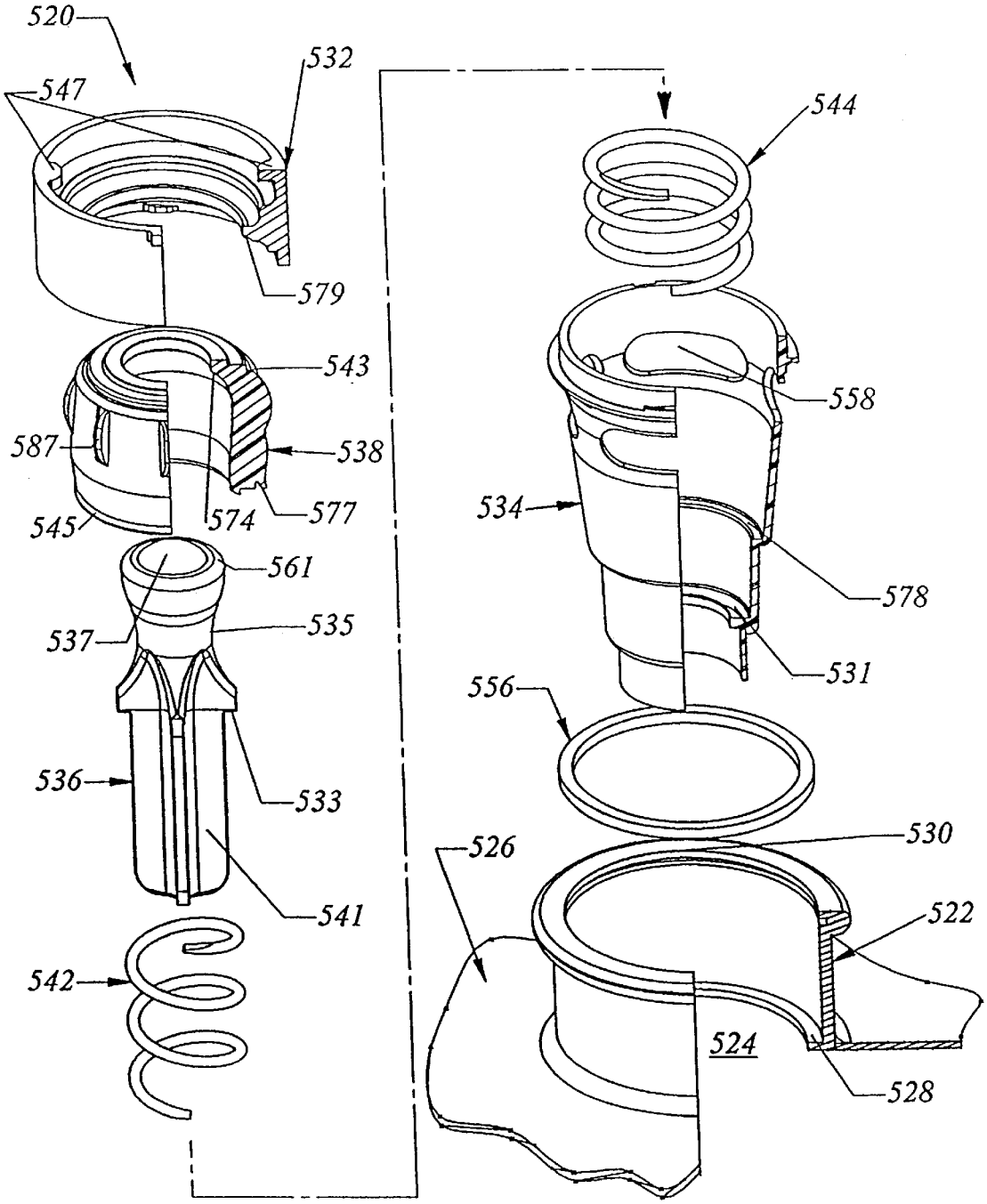
FIG. 21 is an exploded perspective view of the valve assembly of FIGS. 17–20.

In addition, and unlike in the previous embodiments in which the dispensing tower is incapable of downward movement from its neutral position, the dispensing tower 536 is slidable downwardly independently of the sealing ring 538. The dispensing tower 536 of this embodiment also upwardly moves relative to the sealing ring 538 in the pressure relief mode. Measures therefore are preferably incorporated into the design of the dispensing tower 536 to permit fluid flow between the dispensing tower 536 and the sealing ring 538 during pressure relief. Towards these ends, the body 535 of the dispensing tower 536 is formed with one or more external channels or grooves 541 in the surface thereof that extend at least generally axially from the bottom of the dispensing tower 536 to just above the shoulder 533. In the illustrated embodiment, and as best seen in FIG. 21, several channels 541 are formed by forming the lower portion of the body 535 with a fluted or generally cross-shaped cross section to form four such channels 541 around the periphery of the lower portion of dispensing tower 536. However, a lesser or greater number of channels could be formed to accommodate more or less flow, for example.

Figure 17:
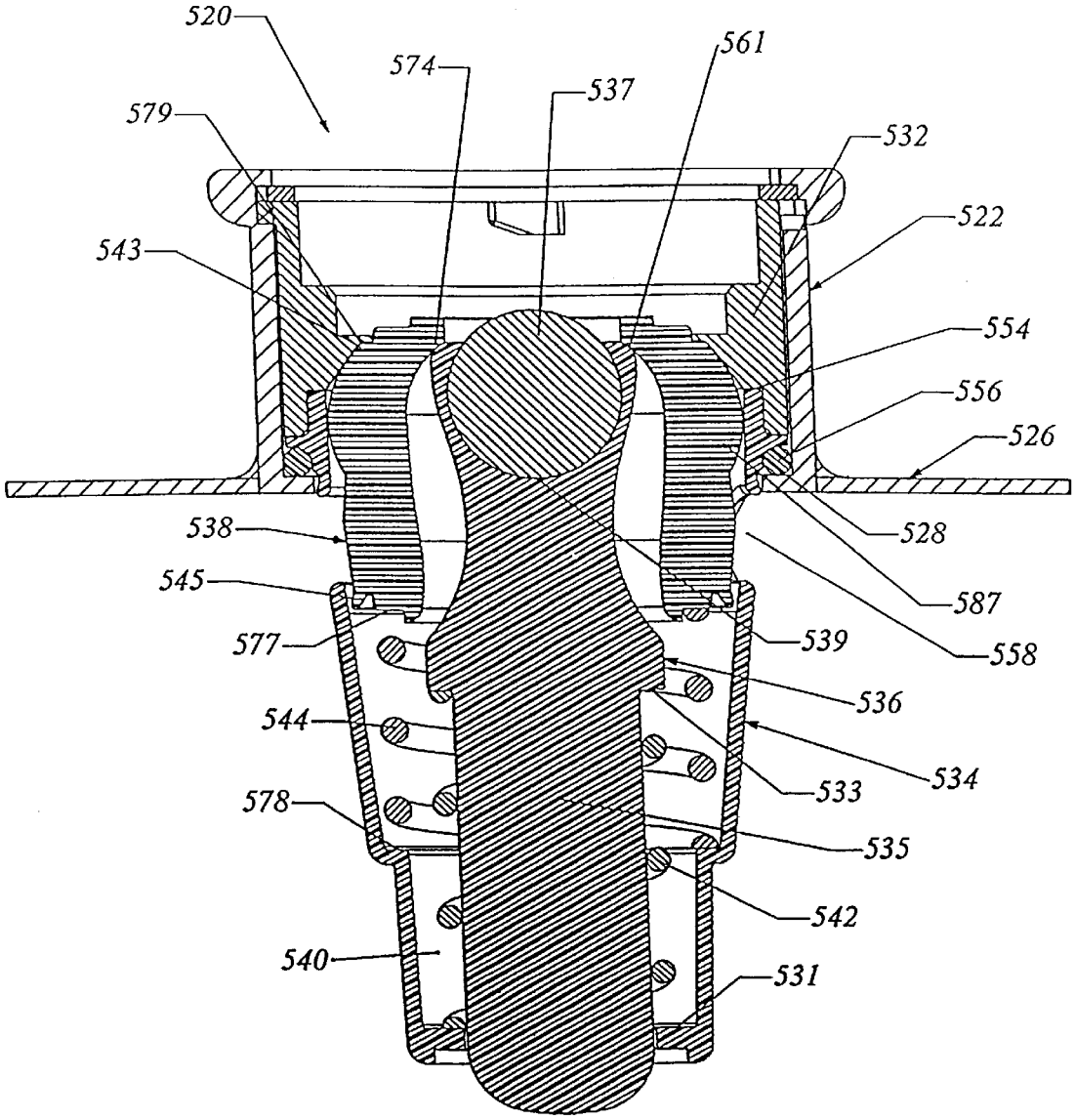
FIG. 17 is a sectional elevation view of a valve assembly according to a fifth embodiment of the invention and showing the valve assembly in its neutral or closed position.

The sealing ring 538, and particularly the outer periphery thereof, could be identical in construction and operation to the sealing ring 338 of the third embodiment. However, the illustrated and currently-preferred sealing ring 538 differs from the sealing rings the first and third embodiments primary in that 1) it lacks the pronounced sealing lips and 2) it seals against the valve housing 532 rather than the riser pipe 534 when it is in its neutral or closed position. The sealing ring 538 also curves inwardly at its upper end to form a lip-like structure (hereafter known simply as a "lip" 574). As best seen in FIG. 17, lip 574 acts as a stop against which the shoulder of the dispensing tower 536 seals when the valve assembly 520 assumes its neutral or closed position. The lip 574, and preferably the entire sealing ring 538, is made of a resilient material such as neoprene or EPDM, or other resilient material suitable for use in connection with food or beverage containers.

The functions of the outer sealing lip of the previous embodiments are performed in this embodiment by upper and lower sealing members 543 and 545 which sequentially seal at locations above and below the ingress/egress portals 558 as the sealing ring 538 moves downwardly in the chamber 540. The upper sealing member 543 comprises a stepped shoulder which engages a stepped groove 579 in valve housing 532 when the valve assembly 520 assumes its neutral or closed position. Stepped groove 579 presents a double seal so that at least two surfaces of the upper sealing member 543 are sealingly engaged when the valve is closed. Stepped groove 579 also serves as a stop that retains the sealing ring 538 in the valve assembly 520. The sealing ring 538 is biased into engagement with the stepped groove 579 by the spring 544, which rests in a spring groove 577 in the base of the sealing ring 538 at its upper end and on an intermediate radial flange 578 of the riser pipe 534 at its lower end. The lower sealing member 545 takes the form of an outer peripheral surface of the lower portion of the sealing ring 538 which sealingly engages the tapered riser pipe 534 as the sealing ring 538 moves downwardly within the chamber.

In addition, and as in the previous embodiments, a plurality of centering projections are provided on the I.D and/or the O.D. of the sealing ring 538 to guide and stabilize the sealing ring 538 with respect to the member they contact while maintaining the eccentricity of these elements and permitting the free-flow of fluid past the projections. In the illustrated embodiment, centering projections 587 are formed integrally with the remainder of the sealing ring 538 and abut the riser pipe 534 so as to guide and stabilize the sealing ring 538 with respect to the riser pipe 534. The projections 587 may be either arcuate as illustrated, frustoconical as in the previous embodiments, or any other desired shape. Projections may, if desired, be provided on the L.D. of the sealing ring 538 instead of or in addition to the projections 587 in order to guide and stabilize the sealing ring 538 relative to the dispensing tower 536.

An additional feature of the fifth embodiment is the substitution of a layer 554 of structural two-part adhesive for the sealing ring or gasket of the preferred embodiment such as the sealing rings 54 and 354 of the first and third embodiments. Adhesive layer 554 provides the same sealing capability of the sealing rings and also adds additional structural integrity to the joint, thereby unifying valve housing 532 and the riser pipe 534 into a single riser pipe. The layer 554 is sealed against the stub 522 by an O-ring seal 556 that engages a radius or curved surface 557 on the inner surface of the layer 554. This relationship helps clamp the O-ring 556 into position more clearly and to prevent it from twisting, thereby enhancing the integrity of the seal.

In the neutral or closed mode, best seen in FIG. 17, dispensing tower 536 is sealingly urged against sealing ring 538 by the second spring 542, and the upper seal 543 of the sealing ring 538 is sealingly urged against the annular groove 579 by both springs 544 and 542. As a result, and as in the previous embodiments, the ingress/egress portals 558 and chamber 540 share the same pressure, thereby allowing the liquid in container 526 to seek its own level away from portals 558 via the inlet of the riser pipe 534. This in turn improves the coupling safety when a coupling arrangement is attached to the valve assembly 520.

Figure 18:
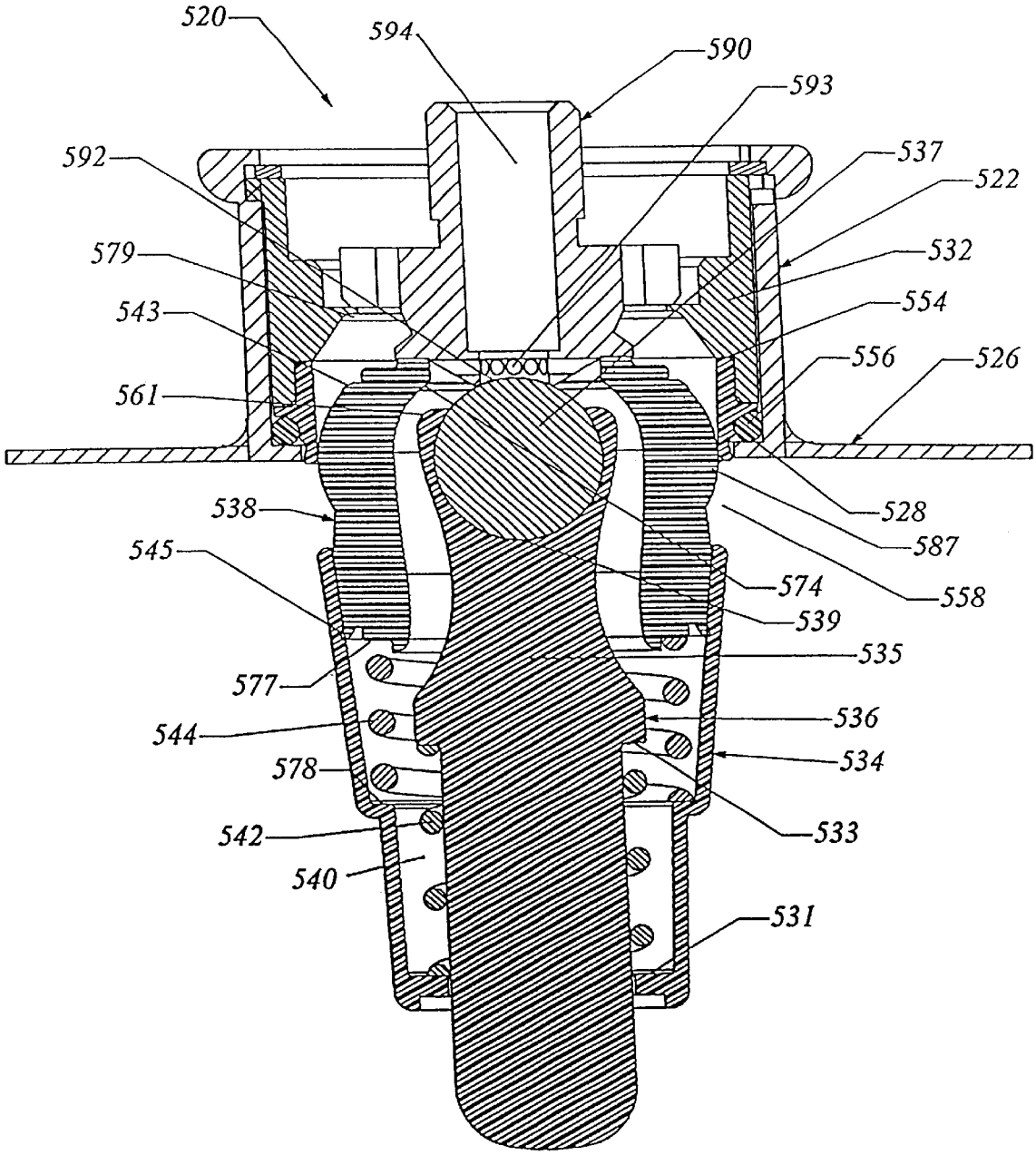
FIG. 18 is a sectional elevation view of the valve assembly of FIG. 17 showing the valve assembly in its normal or working mode.

As best shown in FIG. 18, when a spindle 590 is inserted into the bore of the valve assembly 520 and turned on its axis, it engages a pair of lugs 547 (FIG. 21) in bayonet-like fashion in a manner which is, per se, well known. Alternatively, the spindle 590 may be threaded into the bore of the valve assembly 520. The spindle 590 illustrated in FIG. 18 has been custom modified from the standard spindle in order to present a cylindrical radially centered axial projection 592 on the end of spindle 590. Projection 592 serves to drive the dispensing tower 536 downwardly against the force of second spring 542 to create a valve opening between dispensing tower 536 and the lip 574 of sealing ring 538 so as to permit the passage of liquid through the valve opening, through a number of radial holes 593 in the projection 592, and up into the liquid channel 594 of spindle 590.

The spindle 590 also contacts sealing ring 538 as it moves downwardly and forces sealing ring 538 downwardly to expose portals 558 to incoming gas. In addition, downward movement of sealing ring 538 also causes the lower sealing member 545 of sealing ring 538 to snugly seal against the tapered stationary riser 534 at a location beneath ingress/egress portals 558. Gas/liquid separation therefore is maintained in the same manner as in the previous embodiments. Gas can now enter the container 526 through the portals 558 of riser pipe 534 to push the liquid up the inlet of the riser pipe 534, between the dispensing tower 536 and the sealing ring 538, and into the spindle 590, where the fluid is dispensed from the system in a conventional manner.

Figure 19:
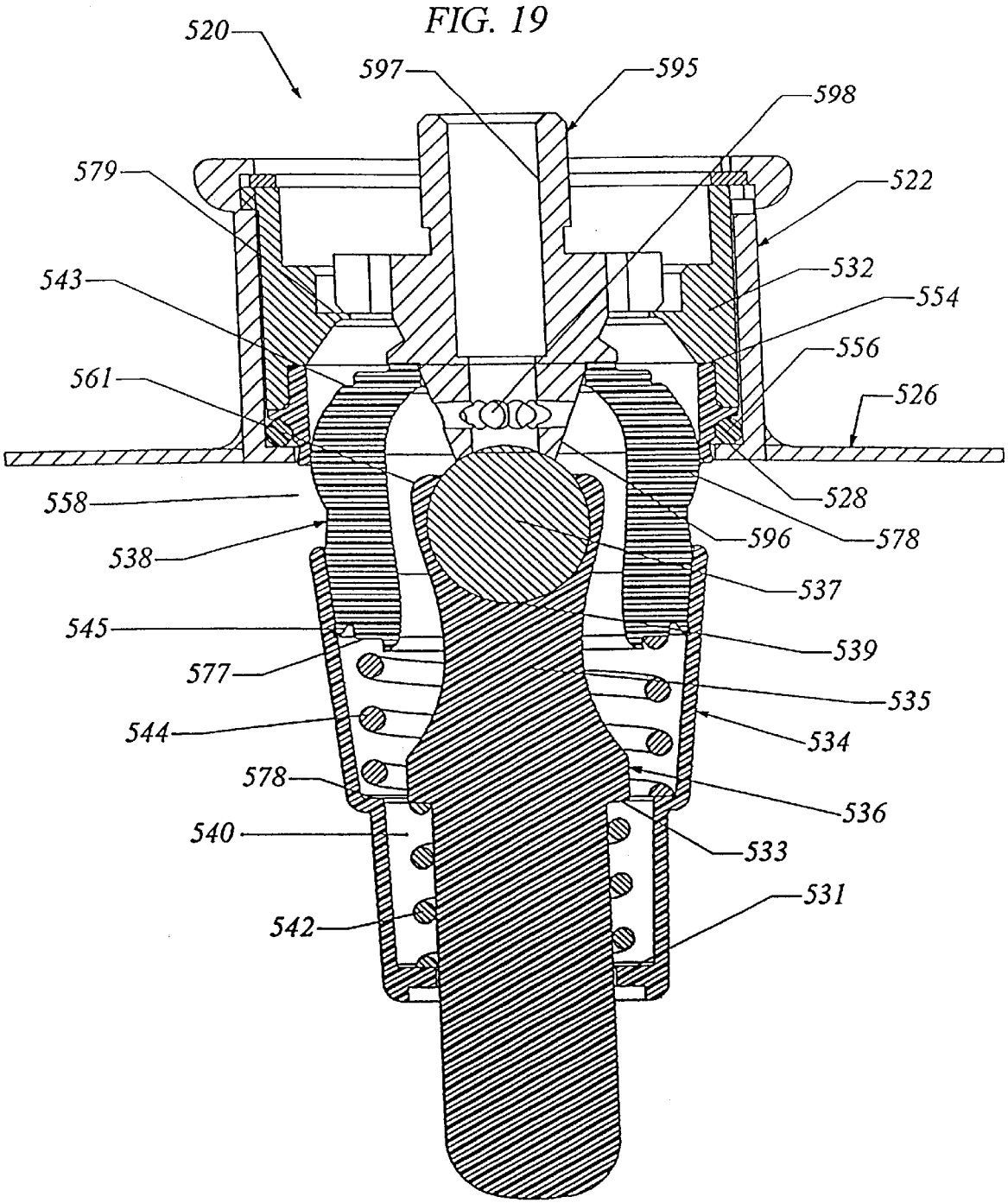
FIG. 19 is a sectional elevation view of the valve assembly of FIGS. 17 and 18 and showing the valve assembly in a wash/fill mode thereof.

Referring now to FIG. 19, the valve assembly 520 is illustrated in a wash/fill mode of operation. In order to accommodate rapid washing and filling of container 526, dispensing tower 536 is capable of even further downward movement than the movement required for the normal dispensing mode. A wash/fill fitting 595 is inserted into the bore of the valve assembly 526 and has a wash/fill protrusion 596 extending downwardly therefrom to displace the dispensing tower 536 downwardly. This protrusion is longer than the projection 592 of the dispensing spindle 590 so as to effect greater relative movement between the dispensing tower 536 and the sealing ring 538. This movement is sufficient to force the shoulder 561 of the dispensing tower 536 to a position far enough beneath the lip 574 of the sealing ring 538 to maximize the area of the annular opening between the dispensing tower 536 and the sealing ring 538. This large opening accommodates the rapid flow of liquid into container 526 from an internal passage 597 and discharge holes 598 of the wash/fill fitting 595 to facilitate washing and filling of the container 526 and valve assembly 520. At the same time, the wash/fill fitting 595 displaces sealing ring 538 downwardly to open portals 558 and to also sealingly engage the I.D. of riser pipe 534 just below portals 558. In this way, as liquid is forced downwardly into the valve assembly 520 in the wash/fill mode, ingress or egress of gas is permitted through portals 558. Conversely, gas may be forced back into the container 526 through portals 558 to accomplish rapid evacuation of the container 526.

Figure 20:
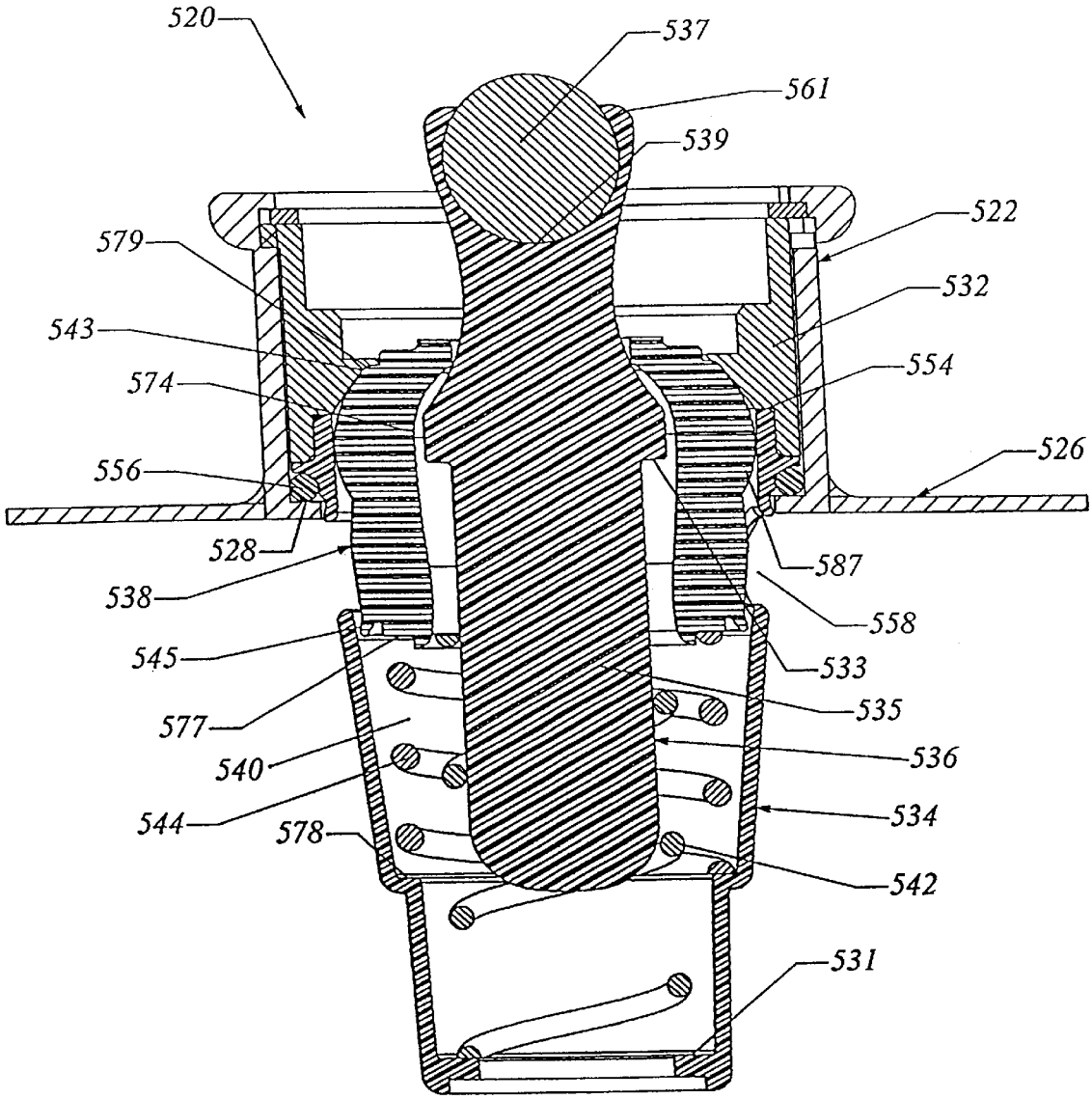
FIG. 20 is a sectional elevation view of the valve assembly according to FIGS. 17–19 and showing the valve assembly in its pressure release or venting mode.

The pressure relief mode is illustrated in FIG. 20. In previous embodiments, the. pressure relief function of the valve assembly is regulated by the tension of the spring 44. In this embodiment, as pressure builds on dispensing tower 536, from below, forces generated by this pressure are opposed by the retaining forces imposed on the dispensing tower 536 by the lip 574. Since sealing ring 538 is made from a resilient material such as EPDM or neoprene, the lip 574 deforms to permit the dispensing tower 536 to move or "pop" up through the sealing ring 538 when the gas pressure from within the container 526 reaches a sufficient magnitude. This movement exposes the upper openings of channels 541 of the dispensing tower 536 to the atmosphere and permits fluid to flow up through the channels 541 and out of the bore of the valve assembly 520. The upper portion of intermediate radial shoulder 533 on the body 535 prevents the dispensing tower 536 from completely exiting the valve assembly 520 during this process. After excess pressure has been released from the container 526, it is necessary to "reset" the valve assembly 520 by manually or mechanically forcing the dispensing tower 536 back to its neutral position beneath the lip 574 of the sealing ring 538.

7. Description of Sixth Embodiment

Still yet another embodiment of the invention is illustrated in FIGS. 22–36. Valve assembly 620 constructed in accordance with this embodiment differs from the valve assembly 520 of the fifth embodiment primarily in that a releasable retainer assembly 710, 712, 714 is provided to prevent unintentional removal of the valve assembly 620 from the container 626. Components of this embodiment corresponding to components of the fifth embodiment are, accordingly, designated by the same reference numerals, incremented by 100. These components include a valve housing 632, a stationary riser pipe 634 including an integral valve cup 631, a dispensing tower 636, and a sealing ring 638 which is disposed in an annular chamber 640 formed between the dispensing tower 636 and the valve cup 631. The movable components of the valve assembly 620 are biased toward their closed position by first and second springs 642 and 644. The valve assembly 620 is configured for fitting into a standard bung or stub 622 mounted over an opening 624 in container 626. The valve cup 631 is mounted on an annular shoulder 628 of the stub 622 and extends into the opening 624. The top of the valve cup 631 is sealed to the valve housing 632 so that the valve housing 632, in effect, forms an extension of the riser pipe 634. In addition, an O-ring seal 656 is clamped between the shoulder 628 on the stub 622 and a lower radius or curved surface 653 on an annular collar 655 on the valve cup 631. As in the similar construction of the fifth embodiment, this relationship helps clamp the O-ring 656 into position more securely and: prevents it from twisting, thereby enhancing the integrity of the seal.

The dispensing tower 636 is formed from a plastic body 635 and a metal contact ball 637 inserted into a socket 639 formed in the upper end of the body 635. As before, the body 635 could be formed from any dimensionally stable food-grade material, and preferably is formed from a food-grade plastics materials for cost and weight considerations. Polysulfone is suitable for these purposes, as is Ultem from General Electric or Vectra from Hoechst. The body 635 includes an upper annular shoulder 661 which is biased into sealing engagement with the sealing ring 638 via the spring 642. It also has external channels or grooves 641 in the surface thereof that extend at least generally axially from the bottom of the dispensing tower 636 to just above the shoulder 633.

The sealing ring 638 also is similar to the sealing ring 538 of the fifth embodiment. It therefore lacks a pronounced sealing lips and seals against the valve housing 632 rather than the valve cup 631 when it is in its neutral or closed position. The sealing ring 638 also curves inwardly at its upper end to form a lip 674 that acts as a stop against which the shoulder of the dispensing tower 636 seals when the valve assembly 620 assumes its neutral or closed position of FIG. 22. An upper stepped shoulder 643 of the sealing ring 638 engages a stepped groove 679 in valve housing 632 when the valve assembly 620 assumes its neutral or closed position. The sealing ring 638 is biased into engagement with the stepped groove 679 by spring 644, which rests on a lip 677 of the sealing ring 638 at its upper end and on an intermediate radial flange 678 of the valve cup 631 at its lower end. A lower sealing member 645, formed from an inner peripheral surface of the lower portion of the sealing ring 638, sealingly engages the valve cup 631 as the sealing ring 638 moves downwardly within the chamber. The centering studs and/or centering projections of the previous embodiments have been eliminated, but could be provided, if desired.

The valve cup 631 of the riser pipe 634 of this embodiment differs from the valve cups of the previous embodiments in several respects. For instance, in order to permit the use of a larger return spring 644, an upwardly extending internal boss 700 is formed in the valve cup 631 to form an annular spring chamber 702 that is located beneath the chamber 640 and that houses the bottom end of the spring 644. The spring chamber 702 is bordered on its inner periphery by the boss 700 and on its outer periphery by an outer wall 704 forming the major surface of the valve cup 631. The boss 700 also forms a seat for the sealing ring 638. Specifically, an inner peripheral surface of the sealing member 645 of the sealing ring 638 seals against an outer peripheral surface of the boss 700.

A retainer assembly, provided on the valve cup 631, is configured to prevent unintended removal of the valve cup 631 and related components (including the dispensing tower 636, the sealing ring 638, and the springs 642 and 644) from the container 626 prior to container venting and to permit removal of these components from the container 626 after the container is vented. The retainer assembly preferably is molded integrally with the plastic valve cup 631. It is configured to take advantage of the elastically deformable nature of the outer wall 704 of the valve cup 631 to permit the wall 704 to selectively distort radially and circumferentially for valve cup insertion or removal.

In the illustrated embodiment, the retainer assembly includes (1) a protrusion 710 that performs ramp and detent functions and (2) a plurality (preferably two) centering skids 712 and 714 that help position the protrusion 710 for a self threading operation when the valve cup 631 is removed from the container 626. The centering skids 712 and 714 and protrusion 710 are preferably spaced equidistantly about the periphery of the valve cup 631 so that each component of the retainer assembly is spaced 120° from the two adjacent components. The three components 710, 712, and 714 are also staggered vertically from one another so as facilitate a self-threading operation during valve cup removal. Hence, the top of the protrusion 710 preferably is positioned about 0.005" below the top of the first centering skid 712 and about 0.005" above the top of the second centering skid 714.

Figure 28:
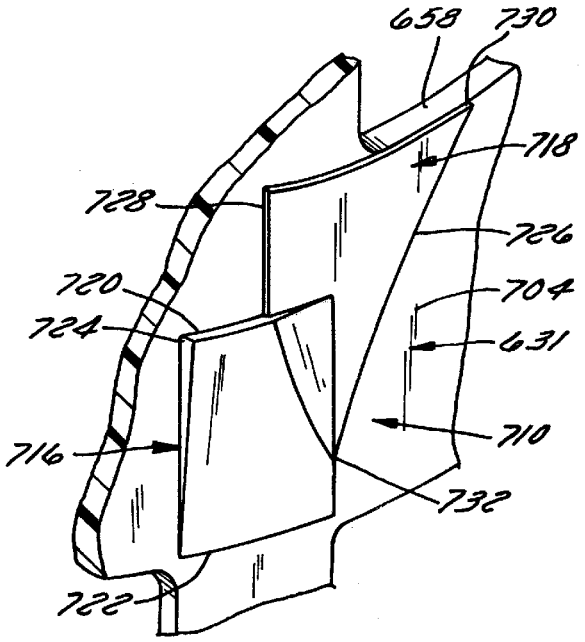
FIG. 28 is a detail view of a protrusion of the valve cup.

Referring specifically to FIG. 28, the protrusion 710 includes a detent portion 716 and a self-threading ramp portion 718. The detent portion 716 tapers radially inwardly from an upper end 720 thereof to a lower end 722 thereof. In the illustrated embodiment in which the clearance between the outer peripheral surface of the valve body 631 and an inner peripheral surface 627 of the shoulder 628 of the stub 622 is approximately 0.010", the upper end 720 of the detent portion 716 has a maximum radial thickness of approximately 0.020" at its trailing edge 724. The lower end 722 of the detent portion 716 has an effective thickness of zero. This configuration permits the valve cup 631 to snap past the shoulder 628 when the valve cup 631 is inserted into the container 626 but prevents unintended removal of the valve cup 631 from the container 626 as detailed below.

Still referring to FIG. 28, self-threading ramp portion 718 is located circumferentially adjacent the detent portion 716 and preferably overlaps it to some extent. The ramp portion 718 has a leading edge 726 having a thickness of 0.000" and a trailing edge 728 having a thickness of about 0.020". The leading edge 726 is inclined towards the trailing edge 728 from an upper end 730 of the ramp portion 718 to a lower end 732 thereof. The trailing edge 728 leads to the detent portion 716, which thereby doubles as a continuation of the ramp portion 718. The combined structure 716 and 718 therefore increases generally uniformly in thickness from an initial thickness of 0.000" at the leading edge 726 of the ramp portion 718 to a final thickness of approximately 0.030" at the trailing edge 724 of the detent portion 716. In the preferred embodiment, (1) the leading edge 726 of the ramp portion 718 preferably is curved at a radius of about 0.520, (2) the detent portion 716 is about 0.250" high by 0.227" wide, (3) the self-threading ramp portion 718 is about 0.440" wide, and (4) the self-threading ramp portion 718 overlaps the detent portion 716 by about 0.227" while extending above the detent portion 716 by a height of about 0.136".

Figure 27:
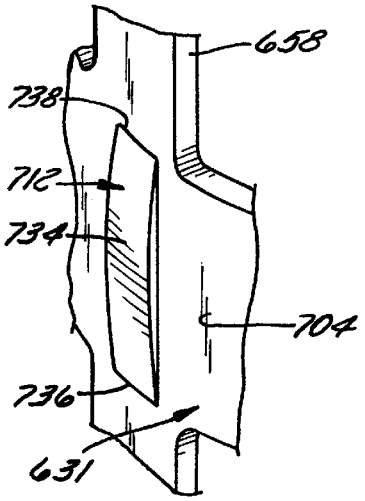
FIG. 27 is a detail view of a centering skid of the valve cup.

The centering skids 712 and 714 are virtually identical to one another. The discussion that follows therefore will focus on the first centering skid 712, it being understood that the discussion is equally applicable to the second centering skid 714. Referring to FIG. 27, the centering skid 712 is essentially rectangular in shape when viewed from its outer radial surface. It is about 0.292" high by about 0.095" wide. It varies in radial thickness from a maximum of 0.005" at its vertical center portion 734 to a minimum effective thickness of 0.000" at each end 736 and 738 thereof. The second centering skid 714 differs from the first centering skid 712 only that it has a height of 0.282" rather than 0.292", thereby providing the above-described staggering effect.

Figure 31:
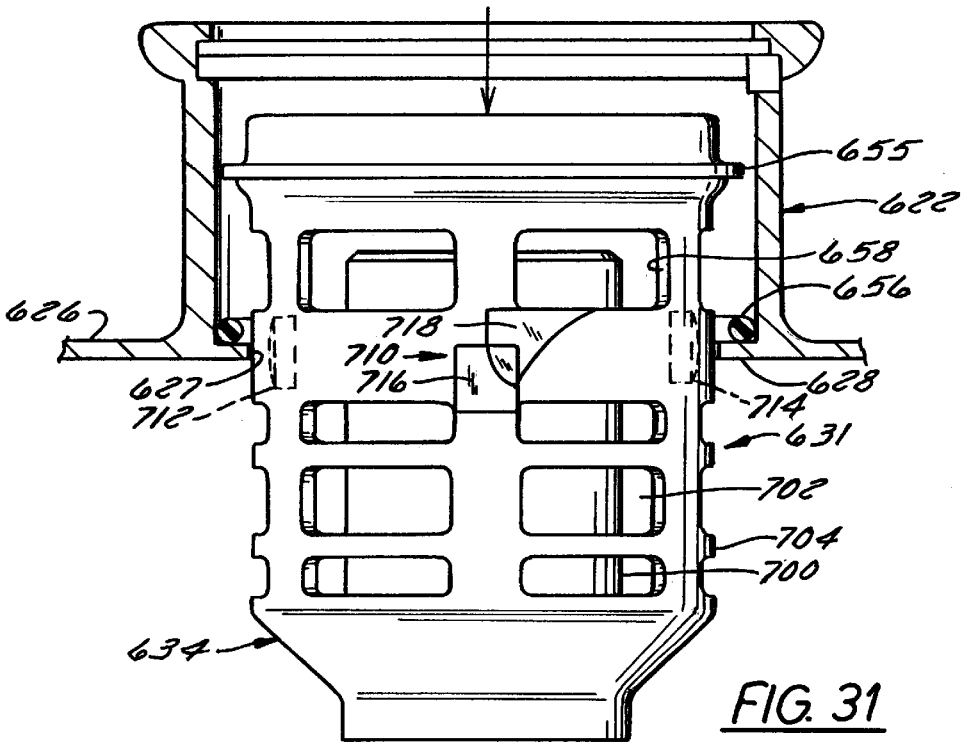
FIG. 31 is a sectional side elevation view illustrating a process of inserting the valve cup into the container.
Figure 30:
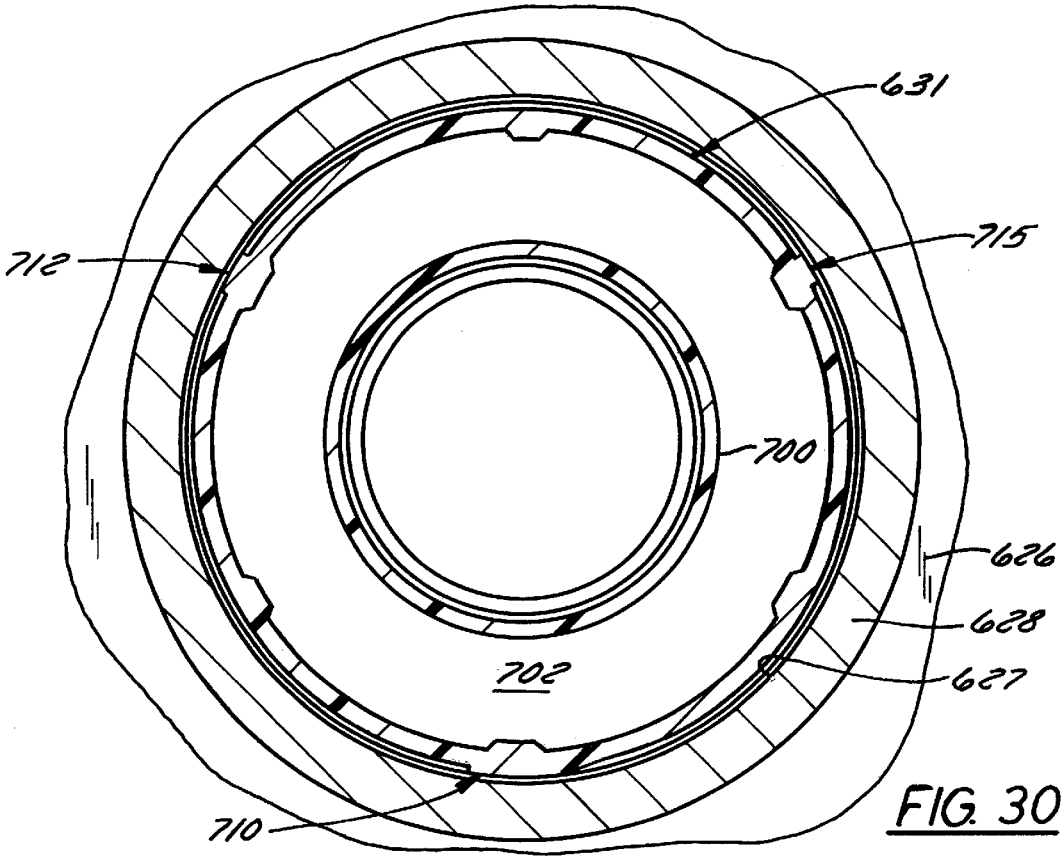
FIG. 30 is a sectional plan view of a portion of the valve assembly including the valve cup.

The insertion and removal of the valve assembly 620 into and from the container 626 now be described. Referring to FIG. 31, the valve cup 631 is inserted into the container 626 simply by forcing it axially downwardly past the shoulder 628 of the stub 622 and into the opening 624 in the container 626. During this time, the detent portion 716 of the protrusion 710 ramps up against the inner peripheral surface 627 of the shoulder 628 to resiliently deflect the outer peripheral wall 704 of the valve cup 631 radially inwardly. When the detent portion 716 clears the shoulder 628, the valve cup 631 returns to its undeflected position, thereafter preventing removal of the valve cup 631 vertically from the container 626. The valve cup 631 can then be pushed downwardly to its at-rest position of FIGS. 23–25, in which the collar 655 is compressed against the O-ring seal 656 and the valve cup 631 is held in place by the valve housing 632 and a snap ring 740.

Figure 32:
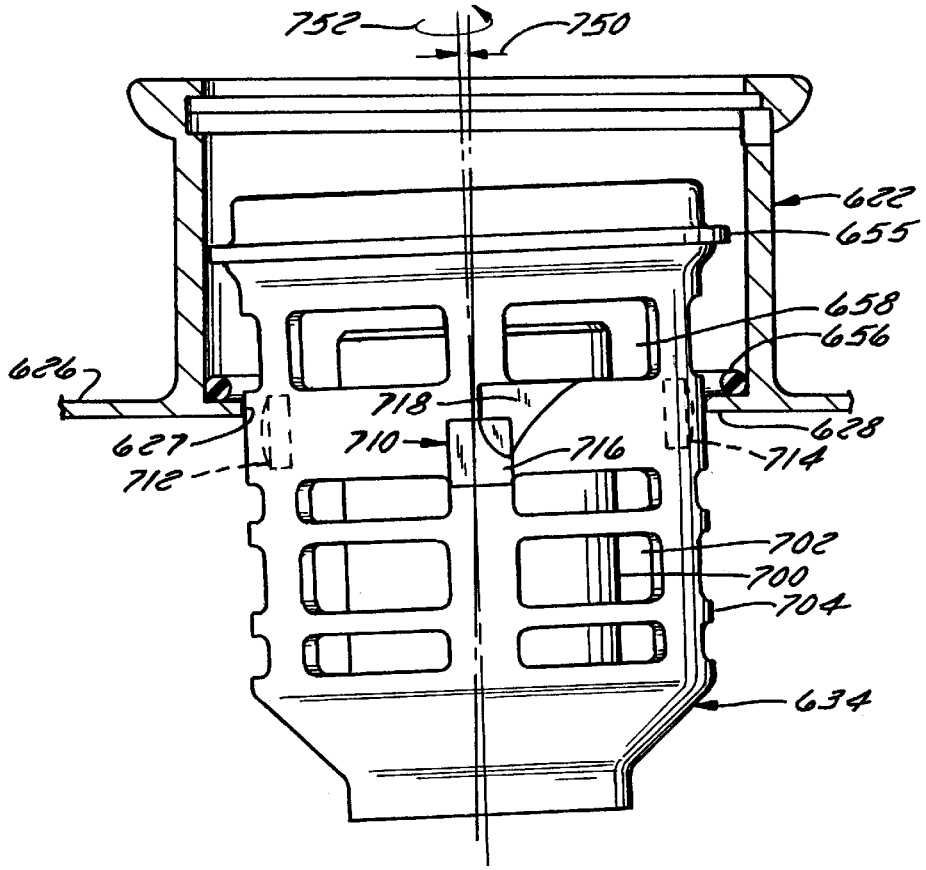
FIG. 32 is a sectional side elevation view illustrating the removal of the valve cup from the container.
Figure 33:
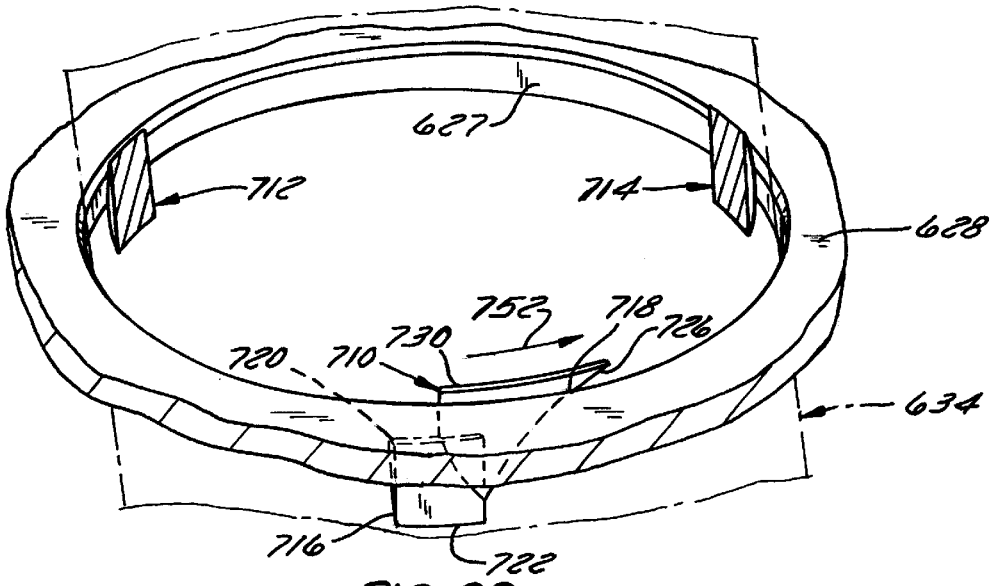
FIG. 33 is a detail perspective view illustrating the manner in which the valve cup is removed from the container.
Figure 35:
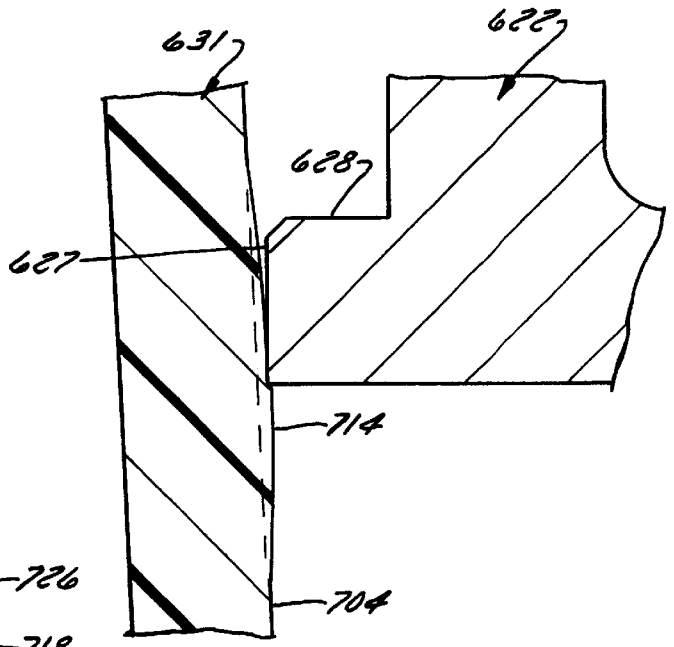
FIGS. 34 and 35 are detail views illustrating the cooperation between centering skids on the valve cup and the adjacent shoulder on the stub of the valve assembly during a valve cup removal process.
Figure 36:
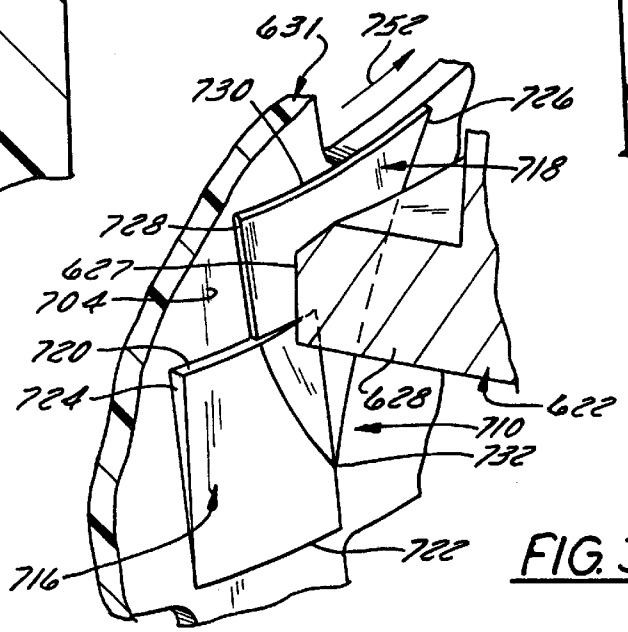
FIG. 36 is a detail view illustrating the cooperation between a protrusion and the shoulder of the stub during a valve cup removal process.
Figure 34:
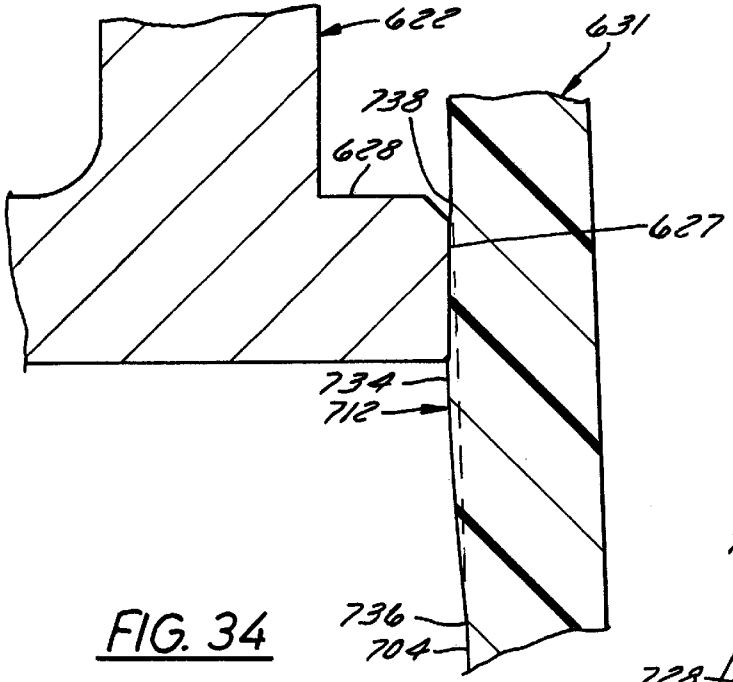

Referring now to FIGS. 32–36, the valve cup 631 and the valve assembly 620 can be removed from the container 626 by lifting the valve cup 631 toward the position seen in FIG. 32 in which the retainer assembly 710, 712, and 714 engages the shoulder 628 on the stub 622. The valve cup 631 is then tilted about its vertical axis as represented by the arrows 750 in FIG. 32, at which time one of the centering skids 712 engages the upper portion of the inner peripheral surface 627 of the shoulder 628 and the other centering skid 714 engages the lower portion of the inner peripheral surface 627 of the shoulder 628 as seen in FIGS. 34 and 35, respectively. At this time, the valve cup 631 is centered in the opening of the container 626 and is wedged against the inner peripheral surface 627 of the shoulder 628. The operator then twists the valve cup 631 counterclockwise as represented by the arrows 752 in FIGS. 32, 33, and 36 while applying vertical lifting forces to the valve cup 631. Because the leading edge 726 of the self-threading ramp portion 718 of the protrusion 710 is wedged against the inner peripheral surface 627 of the shoulder 628 at this time, this twisting motion causes the shoulder 628 to bite into and ramp onto the protrusion 710 in a spiral manner despite the fact that the inner peripheral surface 627 of the shoulder 628 is smooth. This movement is accommodated by circumferential and radial deflection of the outer wall 704 of the valve cup 631. Continued twisting and pulling of the valve cup 631 results in continued upward spiral motion of the valve cup 631 relative to the stub 622 until the detent portion 716 of the protrusion 710 clears the top of the shoulder 628 sufficiently to permit the valve cup outer wall 704 to return to its undeflected position, after which time the valve cup 631, the remainder of the riser pipe 634, and the remainder of the valve assembly 620 can simply be lifted vertically out of the opening 624.

It can thus be seen that the releasable retainer assembly formed by the protrusion 710 and the centering skids 712 and 71 forms a simple, effective mechanism for permitting the controlled insertion of the valve cup 631 into the container 626 and removal of the valve cup 631 from the container 626. All components of the retainer assembly can be molded integrally with the valve cup 631, thereby greatly facilitating manufacturing compared to prior known retainer assemblies such as the safety mechanism disclosed in the Riis patent. Fabrication is further simplified by the fact that no structure need be formed on the shoulder 628 of the stub 622 for cooperating with the structure-the protrusion 710 simply self-threads against the smooth inner peripheral surface of the shoulder 628.

The operation of the valve assembly 620 will now be described.

Figure 22:
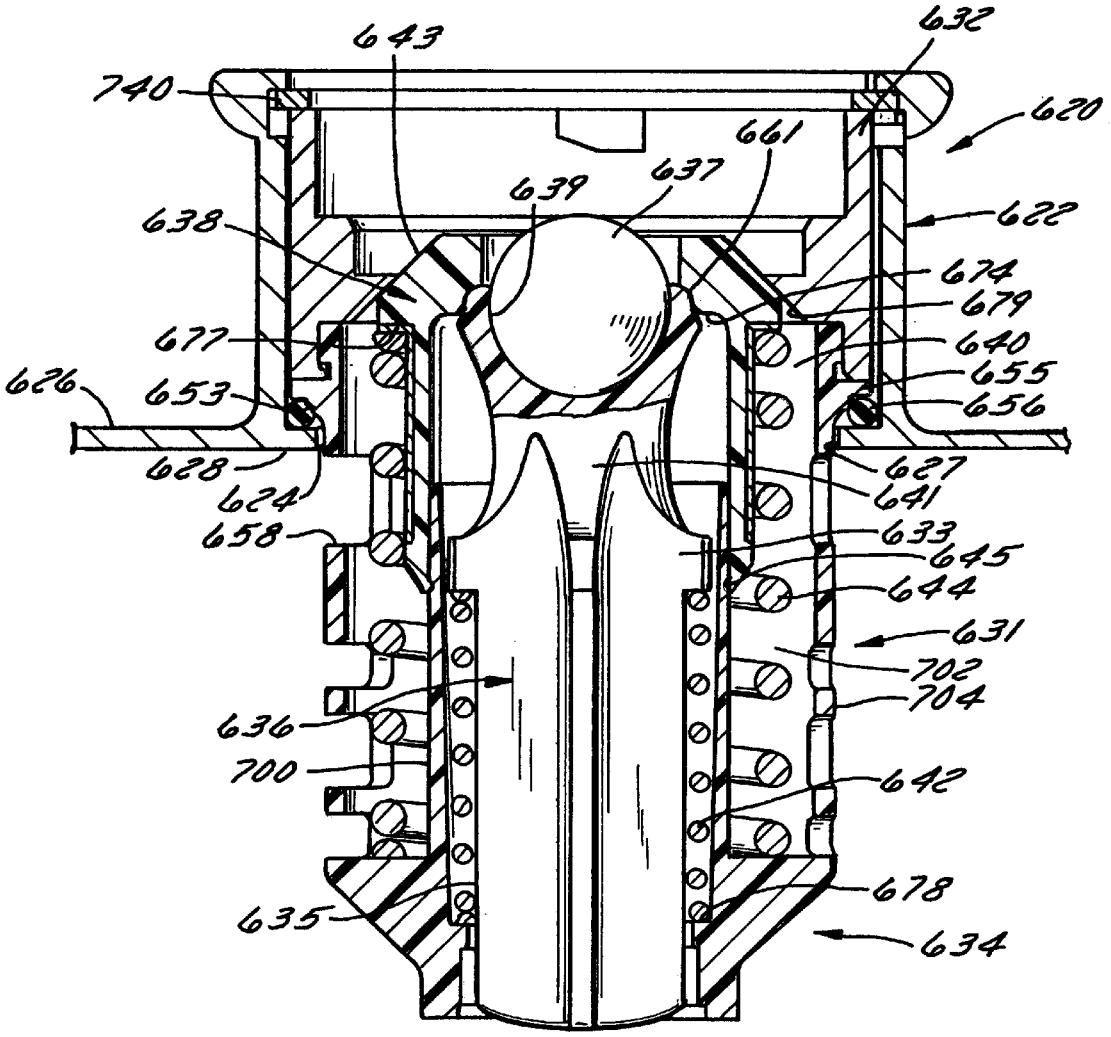
FIG. 22 is a sectional elevation view of a valve assembly according to a sixth embodiment of the invention and showing the valve assembly in its neutral or closed position.

In the neutral or closed mode, best seen in FIG. 22, dispensing tower 636 is sealingly urged against sealing ring 638 by the spring 642, and the upper seal 643 of the sealing ring 638 is sealingly urged against the annular groove 679 by both springs 644 and 642. As a result, and as in the previous embodiments, the ingress/egress portals 658 and chamber 640 share the same pressure, thereby allowing the liquid in container 626 to seek its own level away from portals 658 via the inlet of the riser pipe 634. This in turn improves the coupling safety when a coupling arrangement is attached to the valve assembly 620.

Figure 23:
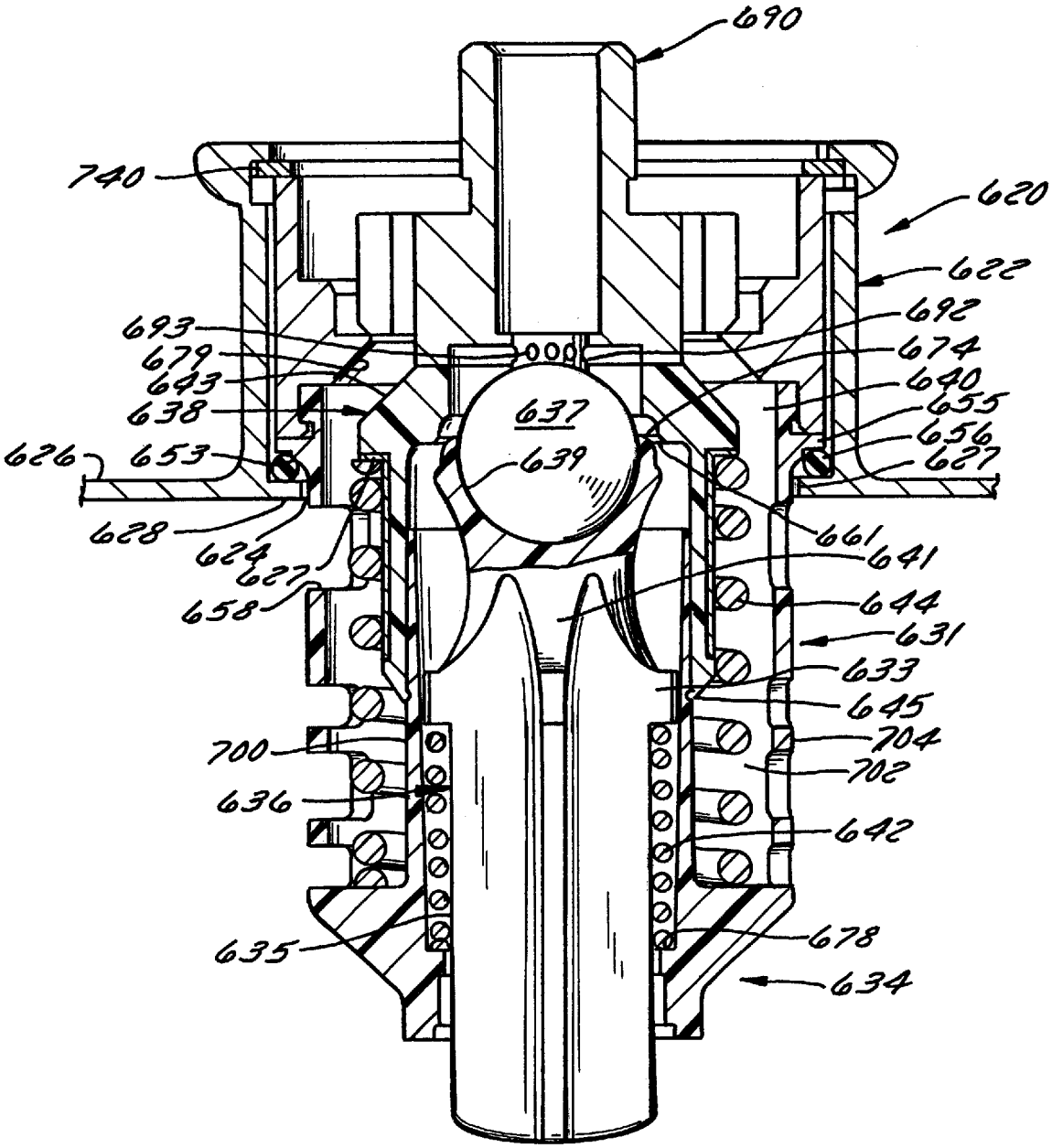
FIG. 23 is a sectional elevation view of the valve assembly of FIG. 22 and showing the valve assembly in its normal or working position.

As best shown in FIG. 23, when a spindle 690 is inserted into the bore of the valve assembly 620 and turned on its axis, it engages a pair of lugs (not shown) in bayonet-like fashion in a manner which is, per se, well known. The spindle 690 illustrated in FIG. 23 has been custom modified from the standard spindle in order to present a cylindrical radially centered axial projection 692 on the end of spindle 690. Projection 692 serves to drive the dispensing tower 636 downwardly against the force of second spring 642 to create a valve opening between dispensing tower 636 and the lip 674 of sealing ring 638 so as to permit the passage of liquid through the valve opening, through a number of radial holes 694 in the projection 692, and up into the liquid channel (not shown) of spindle 690. The spindle 690 also contacts sealing ring 638 as it moves downwardly and forces sealing ring 638 downwardly to expose portals 658 to incoming gas. During this movement, the lower sealing member 645 of sealing ring 638 remains in sealing contact with the boss 700 of the valve cup 631 at a location beneath ingress/egress portals 658. Gas/liquid separation therefore is maintained in the same manner as in the previous embodiments. Gas can now enter the container 626 through the portals 658 of valve cup 631 to push the liquid up the inlet of the integral riser pipe 634, between the dispensing tower 636 and the sealing ring 638, and into the spindle 690, where the fluid is dispensed from the system in a conventional manner.

Figure 24:
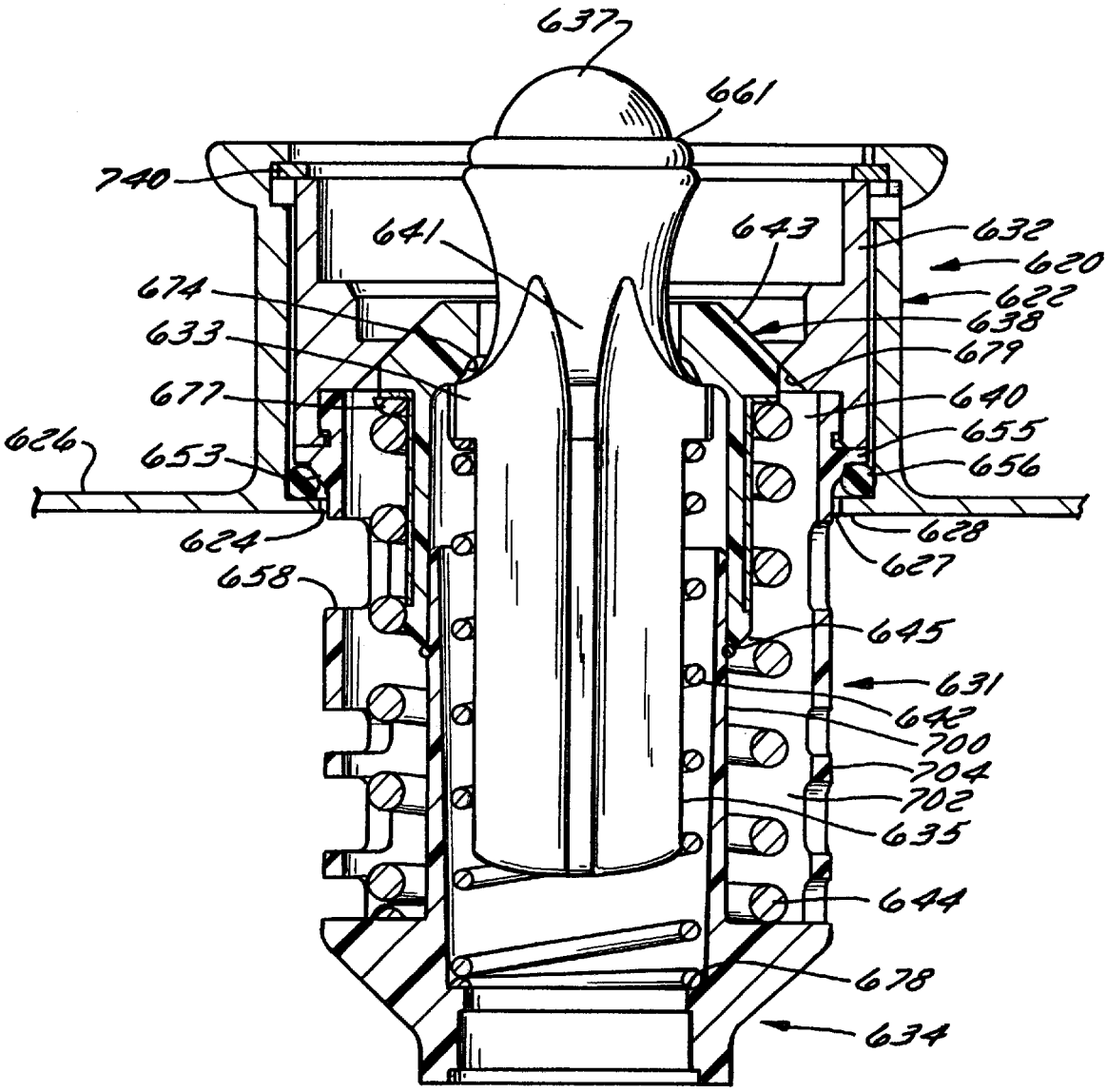
FIG. 24 is a sectional elevation view of the valve assembly of FIGS. 22 and 23 and showing the valve assembly in its pressure release or venting position.
Figure 26:
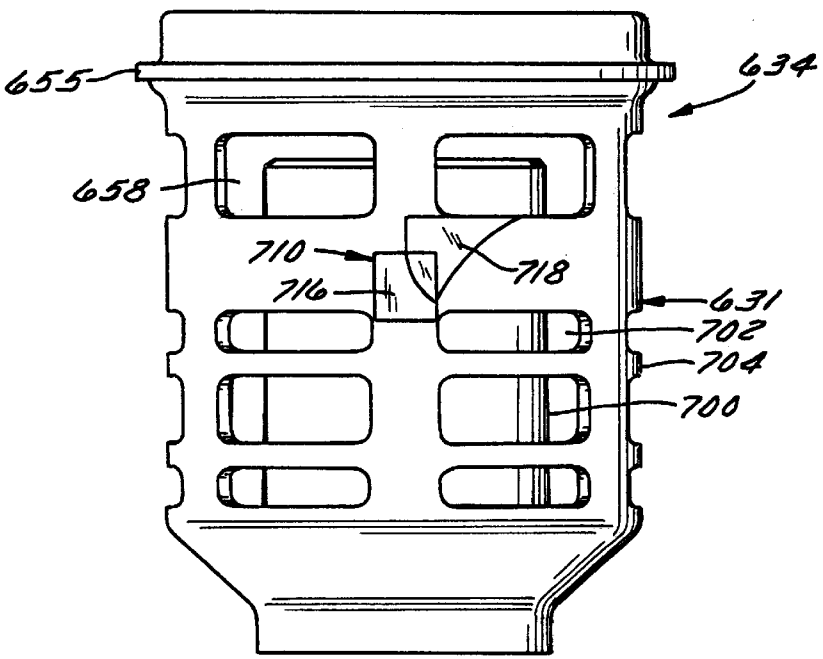
FIGS. 25 and 26 are side and front elevation views, respectively, of a valve cup of the valve assembly of FIGS. 22–24.
Figure 25:
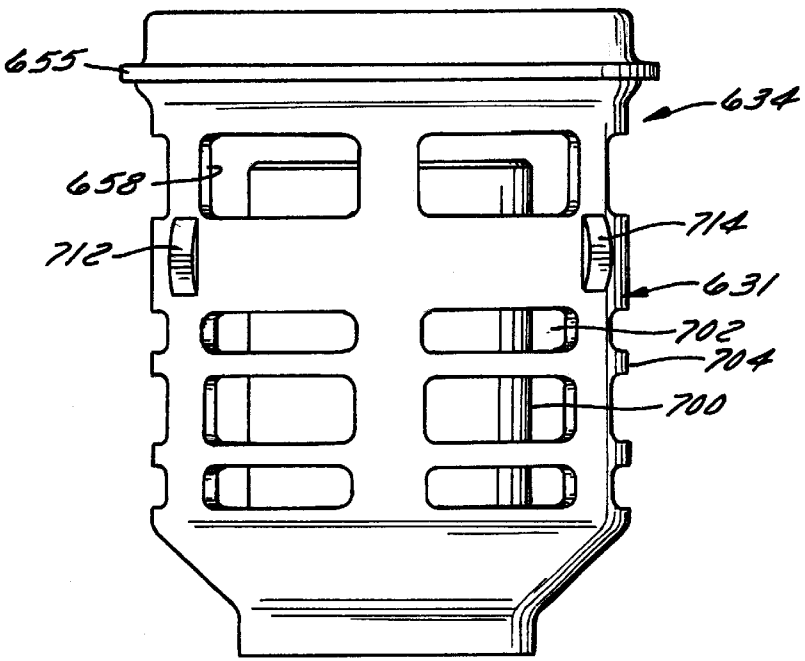
Figure 29:
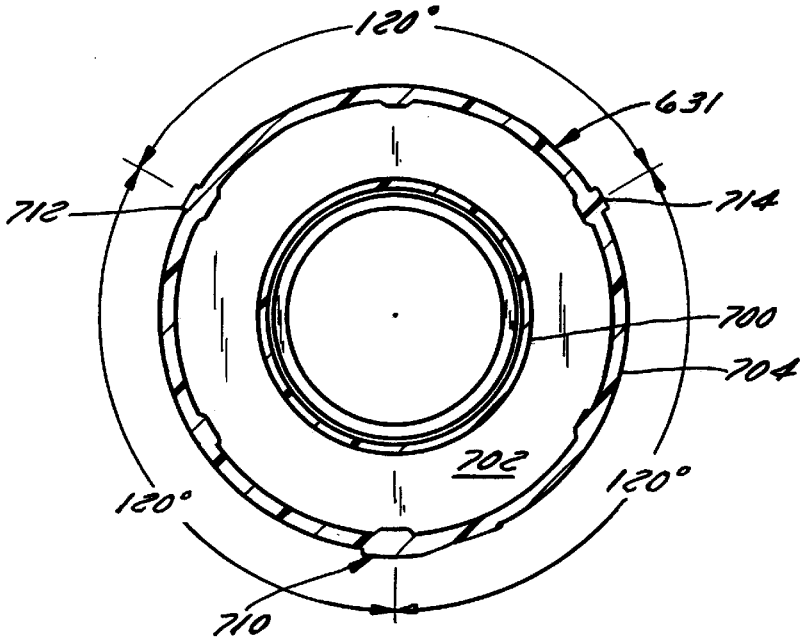
FIG. 29 is a sectional plan view of the valve cup.

The pressure relief mode is illustrated in FIG. 24. In this embodiment, as pressure builds on dispensing tower 636 from below, forces generated by this pressure are opposed by the retaining forces imposed on the dispensing tower 636 by the lip 674. Since sealing ring 638 is made from a resilient material such as EPDM or neoprene, the lip 674 deforms to permit the dispensing tower 636 to move or "pop" up through the sealing ring 638 when the gas pressure from within the container 626 reaches a sufficient magnitude. This movement exposes the upper openings of channels 641 of the dispensing tower 636 to the atmosphere and permits fluid to flow up through the channels 641 and out of the bore of the valve assembly 620. The upper portion of intermediate radial shoulder 639 on the body 635 prevents the dispensing tower 636 from completely exiting the valve assembly 620 during this process. After excess pressure has been released from the container 626, it is necessary to "reset" the valve assembly 620 by manually or mechanically forcing the dispensing tower 636 back to its neutral position beneath the lip 674 of the sealing ring 638.

8. Advantages of Invention

The valve assembly according to the present invention, having the above-mentioned construction, exhibits several benefits. It can be retrofitted to millions of existing containers while at the same time using less parts within the same space than previously-known valve assemblies. The inventive valve assembly therefore exhibits greater cross-sectional ingress and egress areas than previously-known valve assemblies, thereby improving fill rates and reducing costs to the users. It also can control the internal pressure of a container and is adjustable by simply changing the biasing force imposed by springs and/or components of the valve assembly. The valve assembly is bi-directional and is able to use the same portals for both gas and liquid. In addition, it is able to share the same chamber with a gas and a liquid, keeping them separated when working, yet together when at rest, so as not to allow liquid to be present at coupling transition points. The sealing ring of the valve assembly also can maintain perpendicularity and eccentricity with the use of a plurality of conical projections and/or vertical ribs fixed to its I.D. and/or O.D or even the mating dispensing tower as illustrated in FIGS. 9–12 and 17–36. The valve assembly also can control pressure on either side of a single movable molded polymer sealing ring. The releasable retainer assembly on the valve cup of the riser pipe of the embodiment of FIGS. 21–36 facilitates insertion of the valve cup and riser pipe into the container while preventing the valve cup and relating components of the valve assembly from being forced out of the container from pressure within it and still permitting the valve cup to be screwed out of the container without having to machine threads on any components of the valve assembly.

Although the invention has been described through its specific forms, it is to be understood that various changes and modifications may be imparted thereto without departing from the scope of the invention.

I claim:

1. A valve assembly for selectively permitting a liquid to be dispensed from a container under gas pressure within said container, said valve assembly being mountable on a stationary stub surrounding an aperture in said container, said valve assembly comprising:

(A) a valve seat;

(B) a valve element having at least a portion which is movable between a first position in which said valve element seals against said valve seat to block pressurized gas flow into said container and a second position in which said valve element unseats from said valve seat to permit pressurized gas flow into said container and liquid flow out of said container; and (C) a valve cup which is mounted in an opening of said container and which cooperates with said valve element, wherein a releasable retainer assembly is provided on a radially and circumferentially distortable outer wall of said valve cup, said retainer assembly including a protrusion that 1) tapers radially inwardly from an upper portion thereof to a lower portion thereof so as to act as a detent that is configured to engage the stub to distort said outer wall of said valve cup radially inwardly when said valve cup is inserted into the opening from above and which thereafter prevents vertical removal of said valve cup from the opening, and 2) tapers radially outwardly from a circumferential leading portion thereof to a circumferential trailing portion thereof to act as a ramp that is configured to engage the stub and to distort said outer wall of said valve cup when said valve cup is rotated with said retainer assembly in contact with the stub, thereby permitting said valve cup to be rotated out of the stub.

2. The valve assembly as recited in claim 1, wherein said valve element includes (1) a dispensing tower which is positioned radially within said valve cup and which extends at least generally in parallel with said valve cup, a chamber being formed between an internal surface of said valve cup and said dispensing tower, and (2) a sealing ring which is positioned within said chamber, wherein said sealing ring is slidable within said chamber a) from a first position in which said sealing ring seals against said valve seat to prevent gas flow through said valve assembly b) to a second position in which said sealing ring is withdrawn from sealing engagement with said valve seat to permit gas flow through said valve assembly, and wherein said dispensing tower is slidable independently of said sealing ring a) from a first position in which said dispensing tower seals against said sealing ring to prevent liquid flow therebetween b) to a second position in which said dispensing tower is withdrawn from sealing engagement from said sealing ring to permit liquid flow therebetween.

3. The valve assembly as defined in claim 2, further comprising an ingress/egress portal positioned between first and second ends of said valve cup, said ingress/egress portal being isolated from an exterior of said valve assembly when said sealing ring is in said first position and being in fluid communication with the exterior of said valve assembly when said sealing ring is in said second position.

4. The valve assembly as recited in claim 2, wherein said valve cup has an upwardly extending boss which is spaced radially from said outer wall thereof to form a spring cup in which a bottom end of a return spring is located, and wherein an inner peripheral surface of a lower end portion of said sealing ring seals against an outer peripheral surface of said boss.

5. The valve assembly as recited in claim 1, wherein said retainer assembly further comprises first and second radially tapered, vertically extending centering skids that are spaced circumferentially from one another and from said protrusion.

6. The valve assembly as recited in claim 5, wherein both of said centering skids taper radially inwardly from a vertically central portion thereof towards opposed vertical ends thereof.

7. The valve assembly as recited in claim 6, wherein an upper end of said protrusion is positioned above an upper end of one of said first and second centering skids and beneath an upper end of the other of said first and second centering skids.

8. The valve assembly a recited in claim 1, wherein said protrusion includes 1) a detent portion which tapers radially inwardly from an upper portion thereof toward a lower portion thereof and 2) a self-threading ramp portion which is located circumferentially adjacent said detent portion and which tapers radially outwardly from a circumferential leading edge thereof to a circumferential trailing edge thereof.

9. The valve assembly as recited in claim 8, wherein said leading edge of said self-threading ramp portion at least partially overlaps said detent portion.

10. The valve assembly as recited in claim 8, wherein said leading edge of said self-threading ramp portion is curved towards said trailing edge from an upper end of said leading edge to a lower end of said leading edge.

11. A dispenser comprising:

(A) a pressurizable container having an opening formed therein;

(B) a stub mounted on said container over said opening, said stub including an annular shoulder which borders said opening; and (C) a valve assembly which is mounted on said stub, said valve assembly comprising (1) a valve seat;

(2) a valve element having at least a portion which is movable between a first position in which said valve element seals against said valve seat to block pressurized gas flow into said container and a second position in which said valve element unseats from said valve seat to permit pressurized gas flow into said container and liquid flow out of said container; and (3) a valve cup which is mounted in said opening of said container and which cooperates with said valve element, wherein a releasable retainer assembly is provided on a radially and circumferentially distortable outer wall of said valve cup, said retainer assembly including (a) a protrusion that i) tapers radially inwardly from an upper portion thereof to a lower portion thereof so as to act as a detent that is configured to engage said shoulder of said stub and to distort said outer wall of said valve cup radially inwardly when said valve cup is inserted into said opening from above and which thereafter prevents vertical removal of said valve cup from said opening, and ii) tapers radially outwardly from a circumferential leading portion thereof to a circumferential trailing thereof to act as a ramp that is configured to engage said shoulder of said stub and to distort said outer wall of said valve cup when said valve cup is rotated with said retainer assembly in contact with said shoulder, thereby permitting said valve cup to be rotated out of said stub, and (b) first and second radially tapered, vertically extending centering skids that are spaced circumferentially from one another and from said protrusion.

12. The dispenser as recited in claim 11, wherein both of said centering skids taper radially inwardly from a vertically central portion thereof towards opposed vertical ends thereof.

13. The dispenser as recited in claim 12, wherein an upper end of said protrusion is positioned above an upper end of one of said first and second centering skids and beneath an upper end of the other of said first and second centering skids, and wherein, upon lifting of said valve cup into contact with said shoulder and tilting said valve cup within said opening, an upper end portion of one of said first and second centering skids rests against said shoulder and a lower end portion of the other of said first and second centering skids rests against said shoulder.

14. The dispenser as recited in claim 11, wherein said protrusion includes 1) a detent portion which tapers radially inwardly from an upper portion thereof and 2) a self-threading ramp portion which is located circumferentially adjacent said detent portion and which tapers radially outwardly from a circumferential leading edge thereof to a circumferential trailing edge thereof, said self threading ramp portion engaging and ramping onto said shoulder of said stub during a valve cup removal process.

15. The dispenser as recited in claim 11, wherein said valve cup includes an annular collar which is positioned above said shoulder when said valve cup is inserted into said opening, and wherein said collar has a downwardly facing curved surface, and further comprising an O-ring seal which is disposed between said shoulder and said collar and which is distorted by said curved surface on said collar.

16. The dispenser as recited in claim 11, wherein said valve element comprises (1) a dispensing tower which is positioned radially within said valve cup and which extends at least generally in parallel with said valve cup, a chamber being formed between an internal surface of said valve cup and said dispensing tower, and (2) a sealing ring which is positioned within said chamber, wherein said sealing ring is slidable within said chamber a) from a first position in which said sealing ring seals against said valve seat to prevent gas flow through said valve assembly b) to a second position in which said sealing ring is withdrawn from sealing engagement with said valve seat to permit gas flow through said valve assembly, and wherein said dispensing tower is slidable independently of said sealing ring a) from a first position in which said dispensing tower seals against said sealing ring to prevent liquid flow therebetween b) to a second position in which said dispensing tower is withdrawn from sealing engagement from said sealing ring to permit liquid flow therebetween.

17. The dispenser as recited in claim 16, wherein said valve cup has an upwardly extending boss which is spaced radially from said outer wall to form a spring cup in which a bottom end of a return spring is located, and wherein an inner peripheral surface of a lower end portion of said sealing ring seals against an outer peripheral surface of said boss.

18. A method comprising:

(A) inserting a valve cup vertically through an opening in a container, said opening being bordered by an annular member, wherein, during the inserting step, a detent of a retainer assembly on the valve cup engages said annular member and forces an outer wall of said valve cup to elastically distort radially, thereby permitting said valve cup to be forced past said annular member and into said container; and (B) removing said valve cup from said opening by (1) lifting said valve cup to an intermediate position in which additional upward vertical movement of said valve cup is blocked by engagement between an upper surface of said detent and a lower surface of said annular member, then (2) turning said valve cup relative to said annular member so as to cause a radially tapered, circumferentially extending surface on said retainer assembly to engage said annular member and to distort said outer wall of said valve cup, thereby permitting said valve cup to be rotated out of said annular member.

19. The method as recited in claim 18, wherein the removing step comprises, after the step of lifting said valve cup to said intermediate position, tilting said valve cup to force said tapered surface against said annular member.

20. The method as recited in claim 19, wherein, during the tilting step, an upper portion of a first centering skid engages a vertical face of said annular member and a lower portion of a second centering skid engages said vertical face of said annular member, and wherein both of said centering skids taper radially inwardly from a vertically central portion thereof towards opposed vertical ends thereof.

21. The method as recited in claim 18, wherein, during the turning step, said tapered surface self-threads against an essentially planar surface on said annular member.

22. The method as recited in claim 18, wherein said annular member is a shoulder of a stub mounted on said container over said opening.

* * * * *